US010017912B2

(12) United States Patent
Singh et al.

(10) Patent No.: US 10,017,912 B2
(45) Date of Patent: Jul. 10, 2018

(54) WORK VEHICLE WITH IMPROVED LOADER/IMPLEMENT POSITION CONTROL AND RETURN-TO-POSITION FUNCTIONALITY

(71) Applicant: CNH Industrial America, LLC, New Holland, PA (US)

(72) Inventors: Aditya Singh, Andhra Pradesh (IN); Duqiang Wu, Saskatoon (CA); Navneet Gulati, Gujarat (IN)

(73) Assignee: CNH Industrial America LLC, New Holland, PA (US)

( * ) Notice: Subject to any disclaimer, the term of this patent is extended or adjusted under 35 U.S.C. 154(b) by 144 days.

(21) Appl. No.: 14/519,216

(22) Filed: Oct. 21, 2014

(65) Prior Publication Data

US 2016/0108602 A1 Apr. 21, 2016

(51) Int. Cl.
*E02F 3/43* (2006.01)
*E02F 9/22* (2006.01)
(Continued)

(52) U.S. Cl.
CPC ..... *E02F 3/434* (2013.01); *E02F 3/432* (2013.01); *E02F 9/2203* (2013.01); *E02F 9/265* (2013.01)

(58) Field of Classification Search
CPC ..... E02F 3/434; E02F 9/265; E02F 9/2203; E02F 3/432
See application file for complete search history.

(56) References Cited

U.S. PATENT DOCUMENTS 4,811,561 A * 3/1989 Edwards ..... G05B 19/414 340/3.1
4,863,337 A * 9/1989 Ishiguro ..... E02F 3/432 137/636.2
(Continued)

FOREIGN PATENT DOCUMENTS

CN 1703559 A 11/2005
CN 101802417 A 8/2010
(Continued)

OTHER PUBLICATIONS

Extended European Search Report for EP15189352.6, dated Feb. 23, 2016, 7 pages.

*Primary Examiner* — Redhwan k Mawari
*Assistant Examiner* — Rodney P King
(74) *Attorney, Agent, or Firm* — Peter K. Zacharias; Patrick M. Sheldrake

(57) ABSTRACT

A method for automatically controlling the operation of a lift assembly of a work vehicle may generally include receiving an input associated with moving loader arms and/or an implement of the lift assembly to a pre-defined position and monitoring a position of the loader arms and/or the implement relative to the pre-defined position. In addition, while a reference point associated with the loader arms and/or the implement is located outside an outer threshold boundary associated with the pre-defined position, the method may include transmitting a first command signal(s) to move the loader arms and/or the implement towards the pre-defined position. Moreover, when the reference point is moved within the outer threshold boundary, the method may include transmitting a second command signal(s) in order to ramp down a movement velocity of the loader arms and/or the implement as the loader arms and/or the implement is moved closer to the pre-defined position.

19 Claims, 12 Drawing Sheets

(51) Int. Cl.
*E02F 9/20* (2006.01)
*E02F 9/26* (2006.01)

(56) References Cited

U.S. PATENT DOCUMENTS

| | | | | |
|---|---|---|---|---|
| 5,467,541 | A | 11/1995 | Greer et al. | |
| 6,061,617 | A | 5/2000 | Berger et al. | |
| 6,371,214 | B1 | 4/2002 | Anwar et al. | |
| 6,778,097 | B1 * | 8/2004 | Kajita | E02F 3/437 340/12.5 |
| 7,140,830 | B2 | 11/2006 | Berger et al. | |
| 7,530,185 | B2 | 5/2009 | Trifunovic | |
| 7,712,309 | B2 | 5/2010 | Vigholm | |
| 8,392,075 | B2 | 3/2013 | Mindeman et al. | |
| 8,500,387 | B2 | 8/2013 | Trifunovic | |
| 8,560,181 | B2 | 10/2013 | Ekvall et al. | |
| 2005/0102866 | A1 | 5/2005 | Sewell et al. | |
| 2008/0162000 | A1 * | 7/2008 | Dattilo | B62D 6/008 701/42 |
| 2011/0150614 | A1 | 6/2011 | Nicholson et al. | |
| 2011/0153171 | A1 | 6/2011 | Krause et al. | |
| 2013/0004282 | A1 | 1/2013 | Grimes et al. | |
| 2013/0046447 | A1 | 2/2013 | Park | |
| 2013/0085645 | A1 | 4/2013 | Hayashi et al. | |

FOREIGN PATENT DOCUMENTS

| | | | |
|---|---|---|---|
| CN | 102695885 | A | 9/2012 |
| CN | 103148063 | A | 6/2013 |
| CN | 103748366 | A | 4/2014 |
| EP | 0810331 | A1 | 12/1997 |
| EP | 0905325 | A1 | 3/1999 |
| EP | 2535464 | A2 | 12/2012 |
| WO | 2012065157 | A1 | 5/2012 |

* cited by examiner

WORK VEHICLE WITH IMPROVED LOADER/IMPLEMENT POSITION CONTROL AND RETURN-TO-POSITION FUNCTIONALITY

FIELD OF THE INVENTION

The present subject matter relates generally to work vehicles and, more particularly, to a system and method for automatically controlling the operation of a lift assembly of a work vehicle to allow the vehicle's loader arms and/or implement to be moved or returned to a pre-defined position.

BACKGROUND OF THE INVENTION

Work vehicles having lift assemblies, such as skid steer loaders, telescopic handlers, wheel loaders, backhoe loaders, forklifts, compact track loaders and the like, are a mainstay of construction work and industry. For example, skid steer loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arm, which allows the skid steer loader to be used to carry supplies or particulate matter, such as gravel, sand, or dirt, around a worksite.

Control systems have been disclosed in the past that allow for a pre-defined position for the loader arms or implement to be stored within a vehicle's controller. Upon selection of the pre-defined position by the operator, the controller attempts to automatically control the movement of the loader arms or the implement in order to move such component to the pre-defined position. Unfortunately, existing control systems often lack the ability to accurately position the loader arms or the implement in response to the operator's selection of the pre-defined position. For example, these control systems often utilize simple open-loop control algorithms that fail to provide the accuracy needed to properly position the loader arms or the implement at the operator-selected position. Specifically, conventional control systems often result in under-shooting or over-shooting of the operator-selected position.

Accordingly, an improved system and method for automatically controlling the operation of a vehicle's lift assembly to allow the loader arms and/or the implement to be accurately and efficiently moved to an operator-selected, pre-defined position would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for automatically controlling the operation of a lift assembly of a work vehicle, wherein the lift assembly includes an implement and a pair of loader arms coupled to the implement. The method may generally include receiving an input associated with an instruction to move the loader arms and/or the implement to a pre-defined position and monitoring a position of the loader arms and/or the implement relative to the pre-defined position. In addition, while a reference point associated with the loader arms and/or the implement is located outside an outer threshold boundary defined relative to a reference location associated with the pre-defined position, the method may include transmitting at least one first command signal in order to move the loader arms and/or the implement towards the pre-defined position, wherein the first command signal(s) is associated with moving the loader arms and/or the implement at a movement velocity corresponding to a desired constant velocity. Moreover, when the reference point is moved within the outer threshold boundary, the method may include transmitting at least one second command signal in order to ramp down the movement velocity of the loader arms and/or the implement from the constant velocity as the loader arms and/or the implement is moved closer to the pre-defined position.

In another aspect, the present subject matter is directed to a method for automatically controlling the operation of a lift assembly of a work vehicle, wherein the lift assembly includes an implement and a pair of loader arms coupled to the implement. The method may generally include receiving an input associated with an instruction to move the loader arms and/or the implement to a pre-defined position and monitoring a position of the loader arms and/or the implement relative to the pre-defined position. In addition, while a reference point associated with the loader arms and/or the implement is located outside an outer threshold boundary defined relative to a reference location associated with the pre-defined position, the method may include generating at least one first command signal using a closed-loop velocity control sub-algorithm and transmitting the first command signal(s) to at least one valve in order to move the loader arms and/or the implement towards the pre-defined position, wherein the first command signal(s) is associated with moving the loader arms and/or the implement at a movement velocity corresponding to a desired constant velocity. Moreover, when the reference point is moved within the outer threshold boundary, the method may include generating at least one second command signal using the closed-loop velocity control sub-algorithm or a closed-loop position control sub-algorithm and transmitting the second command signal(s) to the at least one valve in order to ramp down the movement velocity of the loader arms and/or the implement from the desired constant velocity as the loader arms and/or the implement is moved closer to the pre-defined position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
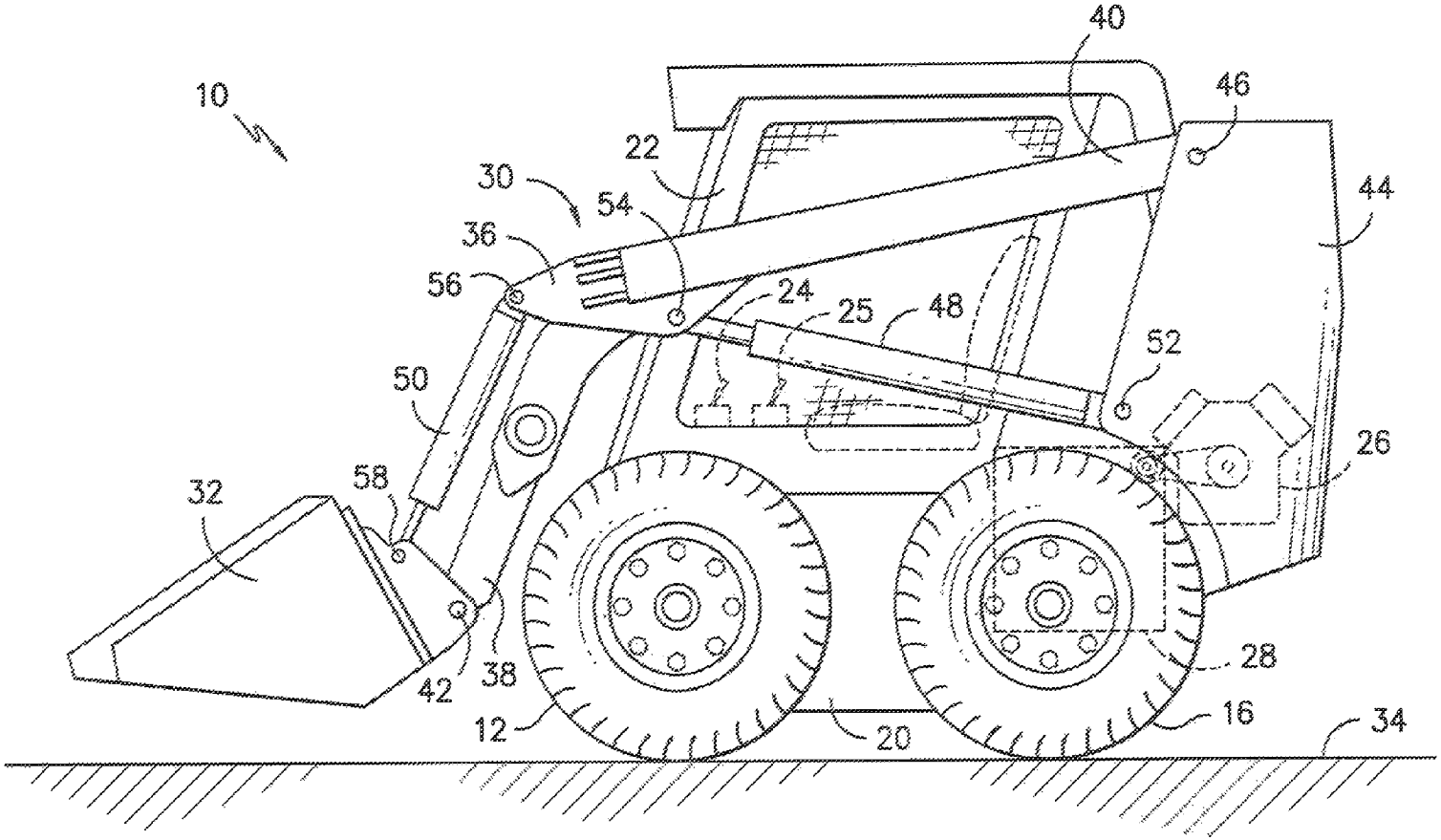
FIG. 1 illustrates a side view of one embodiment of a work vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 illustrates a side view of one embodiment of a work vehicle 10 in accordance with aspects of the present subject matter. As shown, the work vehicle 10 is configured as a skid steer loader. However, in other embodiments, the work vehicle 10 may be configured as any other suitable work vehicle known in the art, such as any other vehicle including a lift assembly that allows for the maneuvering of an implement (e.g., telescopic handlers, wheel loaders, backhoe loaders, forklifts, compact track loaders, bulldozers and/or the like).

As shown, the work vehicle 10 includes a pair of front wheels 12, (one of which is shown), a pair of rear wheels 15 (one of which is shown) and a chassis 20 coupled to and supported by the wheels 12, 16. An operator's cab 22 may be supported by a portion of the chassis 20 and may house various input devices, such as one or more speed control joystick(s) 24 and one or more lift/tilt joystick(s) 25, for permitting an operator to control the operation of the work vehicle 10. In addition, the work vehicle 10 may include an engine 26 and a hydrostatic drive unit 28 coupled to or otherwise supported by the chassis 20.

Moreover, as shown in FIG. 1, the work vehicle 10 may also include a lift assembly 30 for raising and lowering a suitable implement 32 (e.g., a bucket) relative to a driving surface 34 of the vehicle 10. In several embodiments, the lift assembly 30 may include a pair of loader arms 36 (one of which is shown) pivotally coupled between the chassis 20 and the implement 32. For example, as shown in FIG. 1, each loader arm 36 may be configured to extend lengthwise between a forward end 38 and an aft end 40, with the forward end 38 being pivotally coupled to the implement 32 at a forward pivot point 42 and the aft end 40 being pivotally coupled to the chassis 20 (or a rear tower(s) 44 coupled to or otherwise supported by the chassis 20) at a rear pivot point 46.

In addition, the lift assembly 30 may also include a pair of hydraulic lift cylinders 48 coupled between the chassis 20 (e.g., at the rear tower(s) 44) and the loader arms 36 and a pair of hydraulic tilt cylinders 50 coupled between the loader arms 36 and the implement 32. For example, as shown in the illustrated embodiment, each lift cylinder 48 may be pivotally coupled to the chassis 20 at a lift pivot point 52 and may extend outwardly therefrom so to be coupled to its corresponding loader arm 36 at an intermediate attachment location 54 defined between the forward and aft ends 38, 40 of each loader arm 36. Similarly, each tilt cylinder 50 may be coupled to its corresponding loader arm 36 at a first attachment location 56 and may extend outwardly therefrom so as to be coupled to the implement 32 at a second attachment location 58.

It should be readily understood by those of ordinary skill in the art that the lift and tilt cylinders 48, 50 may be utilized to allow the implement 32 to be raised/lowered and/or pivoted relative to the driving surface 34 of the work vehicle 10. For example, the lift cylinders 48 may be extended and retracted in order to pivot the loader arms 36 upward and downwards, respectively, about the rear pivot point 52, thereby at least partially controlling the vertical positioning of the implement 32 relative to the driving surface 34. Similarly, the tilt cylinders 50 may be extended and retracted in order to pivot the implement 32 relative to the loader arms 36 about the forward pivot point 42, thereby controlling the tilt angle or orientation of the implement 32 relative to the driving surface 34. As will be described below, such control of the positioning and/or orientation of the various components of the lift assembly 30 may allow for the loader arms 36 and/or the implement 32 to be automatically moved to one or more pre-defined positions during operation of the work vehicle 10.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration.

Figure 2:
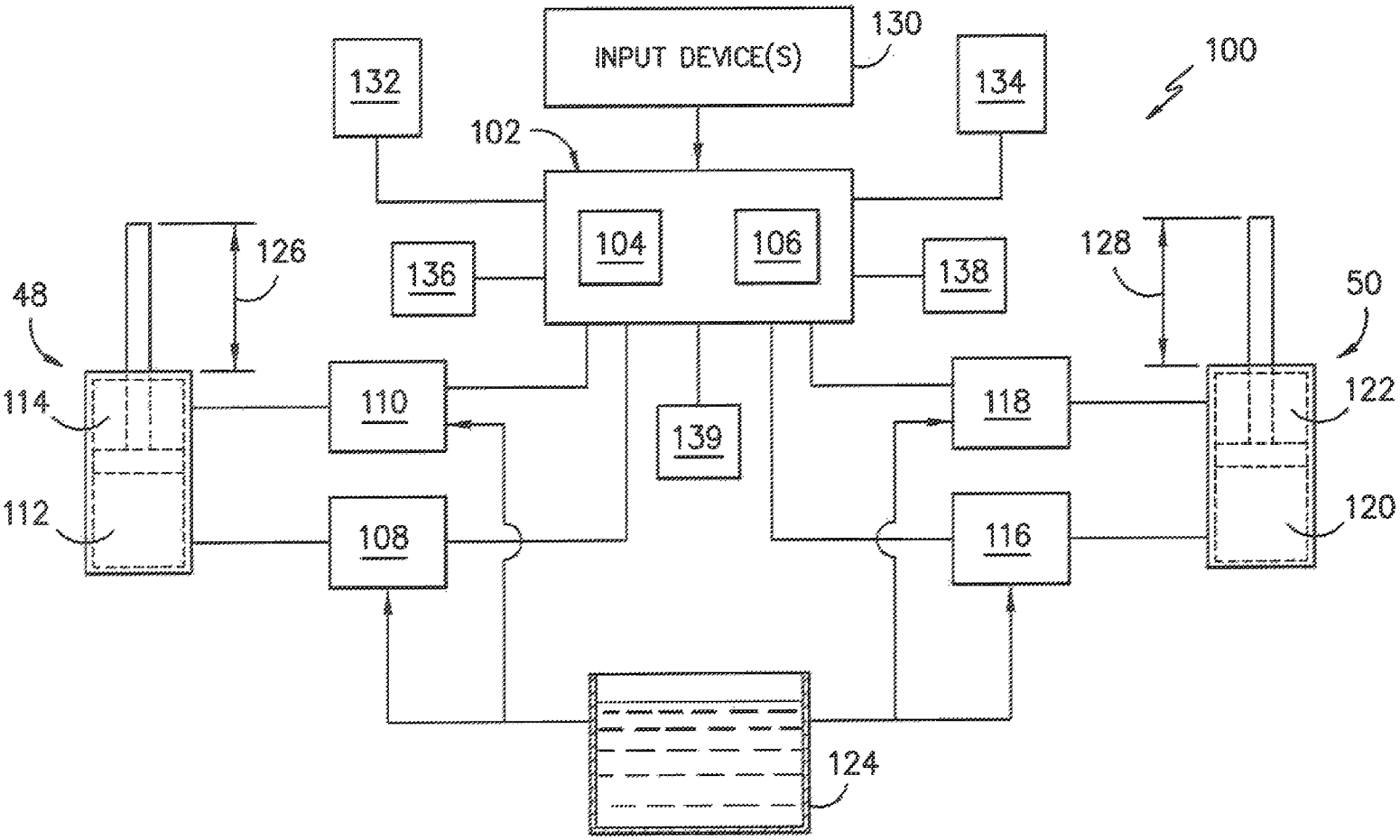
FIG. 2 illustrates a schematic view of one embodiment of a suitable control system for controlling various components of a work vehicle in accordance with aspects of the present subject matter, particularly illustrating the control system configured for controlling various hydraulic components of the work vehicle, such as the valves and associated hydraulic cylinders of the work vehicle.

Referring now to FIG. 2, one embodiment of a control system 100 suitable for automatically controlling the various lift assembly components of a work vehicle is illustrated in accordance with aspects of the present subject matter. In general, the control system 100 will be described herein with reference to the work vehicle 10 described above with reference to FIG. 1. However, it should be appreciated by those of ordinary skill in the art that the disclosed system 100 may generally be utilized to the control the lift assembly components of any suitable work vehicle.

As shown, the control system 100 may generally include a controller 102 configured to electronically control the operation of one or more components of the work vehicle 10, such as the various hydraulic components of the work vehicle 10 (e.g., the lift cylinders 48 and/or the tilt cylinders 50). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the algorithms or methods described below with reference to FIGS. 3 and 4. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 48, 50 of the work vehicle 10. For example, the controller 102 may be communicatively coupled to suitable valves 108, 110 (e.g., solenoid-activated valves) configured to control the supply of hydraulic fluid to each lift cylinder 48 (only one of which is shown in FIG. 2). Specifically, as shown in the illustrated embodiment, the system 100 may include a first lift valve 108 for regulating the supply of hydraulic fluid to a cap end 112 of each lift cylinder 48. In addition, the system 100 may include a second lift valve 110 for regulating the supply of hydraulic fluid to a rod end 114 of each lift cylinder 48. Moreover, the controller 102 may be communicatively coupled to suitable valves 116, 118 (e.g., solenoid-activated valves) configured to regulate the supply of hydraulic fluid to each tilt cylinder 50 (only one of which is shown in FIG. 2). For example, as shown in the illustrated embodiment, the system 100 may include a first tilt valve 116 for regulating the supply of hydraulic fluid to a cap end 120 of each tilt cylinder 50 and a second tilt valve 118 for regulating the supply of hydraulic fluid to a rod end 122 of each tilt cylinder 50.

During operation, the controller 102 may be configured to control the operation of each valve 108, 110, 116, 118 in order to control the flow of hydraulic fluid supplied to each of the cylinders 48, 50 from a suitable hydraulic tank 124 of the work vehicle 10 (e.g., via a hydraulic pump). For instance, the controller 102 may be configured to transmit suitable control commands to the lift valves 108, 110 in order to regulate the flow of hydraulic fluid supplied to the cap and rod ends 112, 114 of each lift cylinder 48, thereby allowing for control of a stroke length 126 of the piston rod associated with each cylinder 48. Of course, similar control commands may be transmitted from the controller 102 to the tilt valves 116, 118 in order to control a stroke length 128 of the tilt cylinders 50. Thus, by carefully controlling the actuation or stroke length 126, 128 of the lift and tilt cylinders 48, 50, the controller 102 may, in turn, be configured to automatically control the manner in which the loader arms 36 and the implement 32 are positioned or oriented relative to the vehicle's driving surface 34 and/or relative to any other suitable reference point.

Additionally, in several embodiments, the controller 102 may be configured to store information associated with one or more pre-defined position settings for the loader arms 36 and/or the implement 32. For example, one or more pre-defined position settings may be stored for the loader arms 36, such as a first loader position setting at which the forward pivot point 42 is located at a first height from the vehicle's driving surface 34 (e.g., a return-to-travel position) and a second loader position setting at which the forward pivot point 42 is located at a greater, second height from the vehicle's driving surface 34 (e.g., a return-to-height position). Similarly, one or more pre-defined defined position settings may be stored for the implement 32, such as a first implement position setting at which the implement 32 is located at a given angular position or orientation relative to the vehicle's driving surface 34 (e.g., a return-to-dig position) and a second implement position setting at which the implement 32 is located at a different angular position or orientation relative to the vehicle's driving surface 34 (e.g., a return-to-dump position). In such embodiments, the various pre-defined position settings stored within the controller's memory 106 may correspond to pre-programmed factory settings and/or operator defined position settings. For instance, as will be described below, the operator may provide a suitable input instructing the controller 102 to learn or record a position setting for the loader arms 36 and/or the implement 32 based on the current position of such lift assembly component(s). The position setting may then be stored within the controller's memory 106 for subsequent use.

It should be appreciated that the current commands provided by the controller 102 to the various valves 108, 110, 116, 118 may be in response to inputs provided by the operator via one or more input devices 130. For example, one or more input devices 130 (e.g., the lift/tilt joystick(s) 25 shown in FIG. 1) may be provided within the cab 22 to allow the operator to provide operator inputs associated with controlling the position of the loader arms 36 and the implement 32 relative to the vehicle's driving surface 34 (e.g., by varying the current commands supplied to the lift and/or tilt valves 108, 110, 116, 118 based on operator-initiated changes in the position of the lift/tilt joystick(s) 25). Alternatively, the current commands provided to the various valves 108, 110, 116, 118 may be generated automatically based on a control algorithm implemented by the controller 102. For instance, as will be described in detail below, the controller 102 may be configured to implement a closed-loop, semi-closed-loop or open-loop control algorithm for automatically moving the loader arms 36 and/or the implement 32 to one or more of the pre-defined positions stored within the controller's memory 106. In such instance, upon selection by the operator of a pre-defined position setting(s), control commands may be automatically generated by the controller 102 via implementation of one of the control algorithms and subsequently transmitted to the lift valve(s) 108, 110 and/or the tilt valve(s) 116, 118 to provide for precision control of the velocity and/or the position of the loader arms 36 and/or the implement 32 as such component(s) is moved to the operator-selected position(s).

Additionally, it should be appreciated that the work vehicle 10 may also include any other suitable input devices 130 for providing operator inputs to the controller 102. For instance, as indicated above, the pre-defined positions for the loader arms 36 and/or the implement 32 may, in one embodiment, correspond to operator-defined position settings. In such instance, the operator may be allowed to position the loader arms 36 and/or the implement 32 at the desired position(s) and subsequently provide an operator input via a suitable input device 130 (e.g., a button or switch) to indicate to the controller 102 that the current position(s) of the loader arms 36 and/or the implement 32 should be saved as a new position setting. Thereafter, the operator may simply provide a suitable input instructing the controller 102 to automatically move the loader arms 36 and/or the implement 32 to the previously stored position setting.

In a particular embodiment, to record a new position setting, the operator may initially instruct the controller 102 to go into a learning mode (e.g., by providing an operator input using a button, switch or other suitable input device 130 housed within the cab 20). The operator may then manually move the loader arms 36 and/or the implement 32 to the desired position(s) and subsequently instruct the controller 102 to store the new position (e.g., by providing a second operator input using a separate button, switch or other suitable input device 130 housed within the cab 20). In one embodiment, once the new position setting has been stored within the controller's memory 106, the operator may be provided with suitable feedback to indicate that the learning operator is complete (e.g., an audible and/or a visual alert).

Moreover, as shown in FIG. 2, the controller 102 may also be communicatively coupled to one or more position sensors 132 for monitoring the position(s) and/or orientation(s) of the loader arms 36 and/or the implement 32. In several embodiments, the position sensor(s) 132 may correspond to one or more angle sensors (e.g., a rotary or shaft encoder(s) or any other suitable angle transducer) configured to monitor the angle or orientation of the loader arms 36 and/or implement 32 relative to one or more reference points. For instance, in one embodiment, an angle sensor(s) may be positioned at the forward pivot point 42 (FIG. 1) to allow the angle of the implement 32 relative to the loader arms 36 to be monitored. Similarly, an angle sensor(s) may be positioned at the rear pivot point 46 to allow the angle of the loader arms 36 relative to a given reference point on the work vehicle 10 to be monitored. In addition to such angle sensor(s), or as an alternative thereto, one or more secondary angle sensors (e.g., a gyroscope, inertial sensor, etc.) may be mounted to the loader arms 36 and/or the implement 32 to allow the orientation of such component(s) relative to the vehicle's driving surface 34 to be monitored.

In other embodiments, the position sensor(s) 132 may correspond to any other suitable sensor(s) that is configured to provide a measurement signal associated with the position and/or orientation of the loader arms 36 and/or the implement 32. For instance, the position sensor(s) 132 may correspond to one or more linear position sensors and/or encoders associated with and/or coupled to the piston rod(s) or other movable components of the cylinders 48, 50 in order to monitor the travel distance of such components, thereby allowing for the position of the loader arms 36 and/or the implement 32 to be calculated. Alternatively, the position sensor(s) 132 may correspond to one or more non-contact sensors, such as one or more proximity sensors, configured to monitor the change in position of such movable components of the cylinders 48, 50. In another embodiment, the position sensor(s) 132 may correspond to one or more flow sensors configured to monitor the fluid into and/or out of each cylinder 48, 50, thereby providing an indication of the degree of actuation of such cylinders 48, 50 and, thus, the location of the corresponding loader arms 36 and/or implement 32. In a further embodiment, the position sensor(s) 132 may correspond to a transmitter(s) configured to be coupled to a portion of one or both of the loader arms 36 and/or the implement 32 that transmits a signal indicative of the height/position and/or orientation of the loader arms/implement 36, 32 to a receiver disposed at another location on the vehicle 10.

It should be appreciated that, although the various sensor types were described above individually, the work vehicle 10 may be equipped with any combination of position sensors 132 and/or any associated sensors that allow for the position and/or orientation of the loader arms 36 and/or the implement 32 to be accurately monitored. For instance, in one embodiment, the work vehicle 10 may include both a first set of position sensors 132 (e.g., angle sensors) associated with the pins located at the pivot joints defined at the forward and rear pivot points 42, 46 for monitoring the relative angular positions of the loader arms 36 and the implement 32 and a second set of position sensors 132 (e.g., a linear position sensor(s), flow sensor(s), etc.) associated with the lift and tilt cylinders 48, 50 for monitoring the actuation of such cylinders 48, 50.

Additionally, as shown in FIG. 2, the controller 102 may also be coupled to one or more engine speed sensors 134 configured to monitor the speed of the vehicle's engine 26 (e.g., in RPMs). In such an embodiment, the engine speed sensor(s) 134 may generally correspond to any suitable sensor(s) that allow for the engine speed to be monitored and communicated to the controller 102. For example, the engine speed sensor(s) 134 may correspond to an internal speed sensor(s) of an engine governor (not shown) associated with the engine 26. Alternatively, the engine speed sensor(s) 134 may correspond to any other suitable speed sensor(s), such as a shaft sensor, configured to directly or indirectly monitor the engine speed. In another embodiment, the engine speed sensor(s) 134 may be configured to monitor the rotational speed of the engine 26 by detecting fluctuations in the electric output of an engine alternator (not shown) of the work vehicle 10, which may then be correlated to the engine speed.

Moreover, it should be appreciated that the controller 102 may be coupled to various other sensors for monitoring one or more other operating parameters of the work vehicle 10. For instance, as shown in FIG. 2, the controller may be coupled to one or more pressure sensors 136 for monitoring the hydraulic pressure supplied within the lift and/or tilt cylinders 48, 50. In such an embodiment, the pressure sensor(s) 136 may, for example, allow the controller 102 to monitor the pressure of the hydraulic fluid supplied to both rod and cap ends 112, 114, 120, 112 of each of the various hydraulic cylinders 48, 50 of the lift assembly 30. Additionally, as shown in FIG. 2, the controller 102 may also be coupled to one or more temperature sensors 138 for monitoring the temperature of the hydraulic fluid within the system 100 and/or one or more tilt or inclination sensors 139 for monitoring the angle of inclination of the work vehicle 10 relative to a horizontal plane extending perpendicular to the direction of the gravitational force acting on the vehicle 10.

Figure 3:
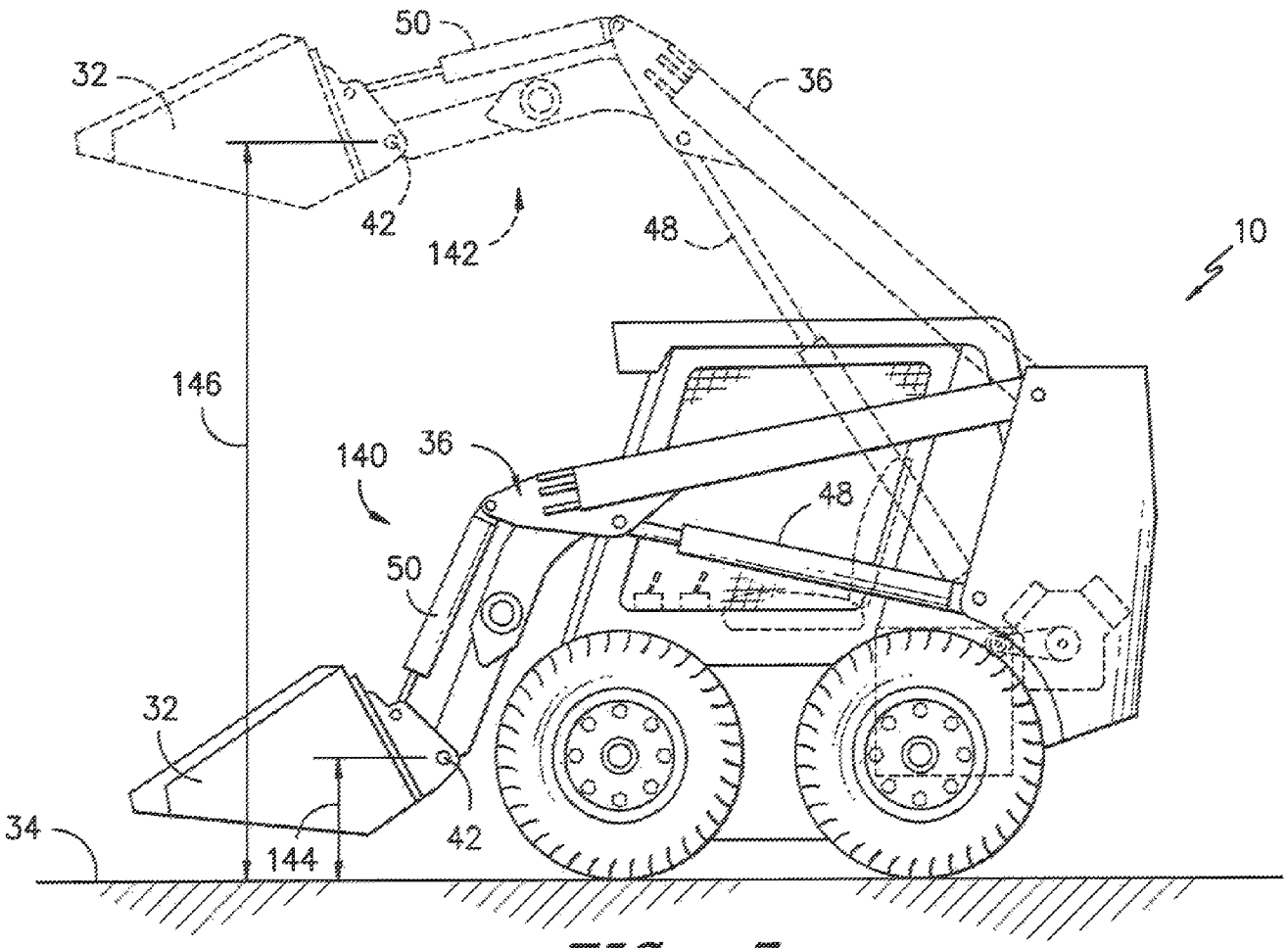
FIG. 3 illustrates another side view of the work vehicle shown in FIG. 1, particularly illustrating two different pre-defined positions that may be stored within a vehicle controller for automatically positioning the vehicle's loader arms.
Figure 4:
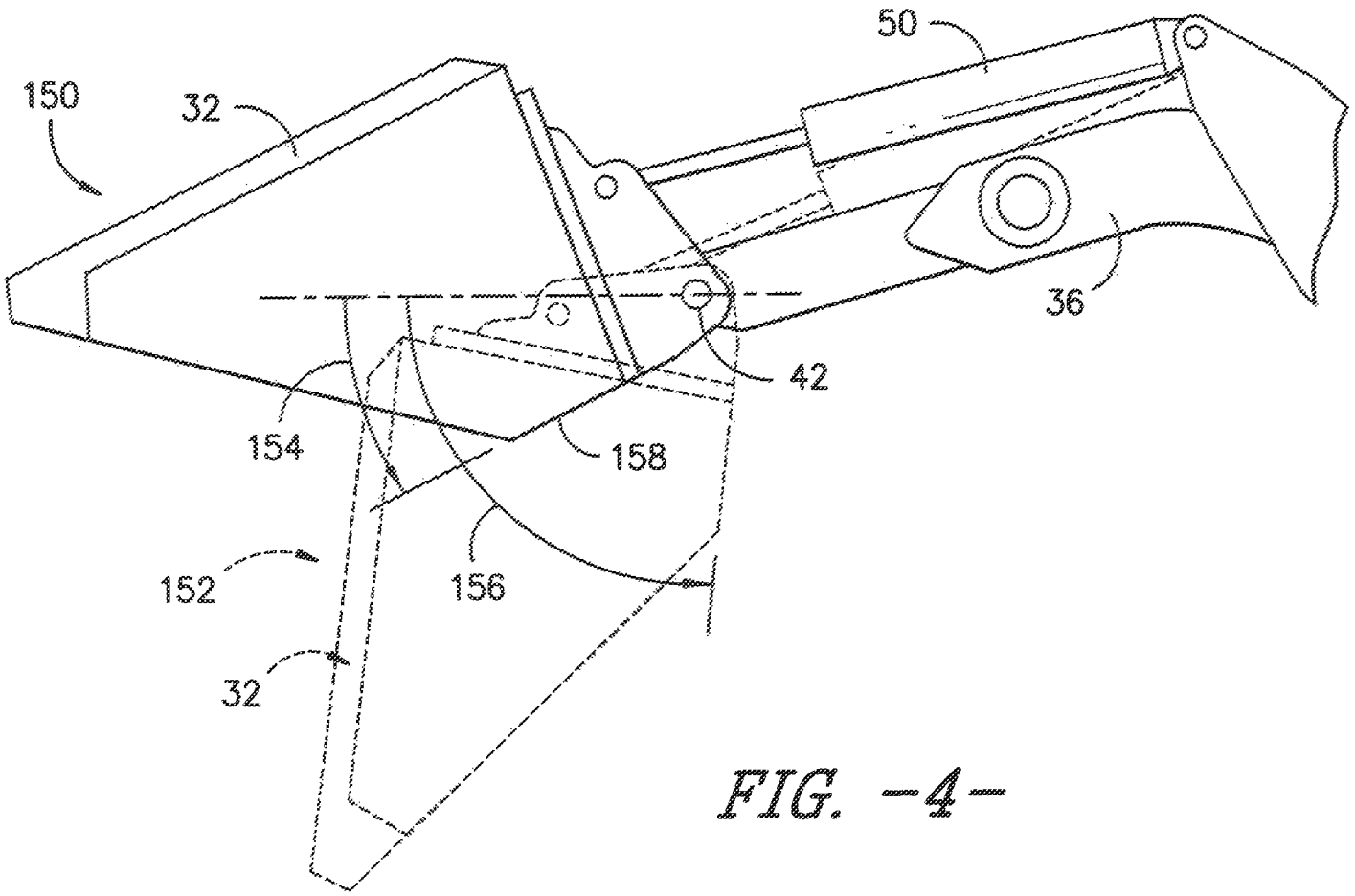
FIG. 4 illustrates a side view of an implement of the work vehicle shown in FIG. 1, particularly illustrating two different pre-defined positions that may be stored within a vehicle controller for automatically positioning the implement.

Referring now to FIGS. 3 and 4, several examples of pre-defined position settings that may be stored within the controller's memory 106 are illustrated in accordance with aspects of the present subject matter. Specifically, FIG. 3 illustrates two different pre-defined position settings that may be stored for the loader arms 36 and FIG. 4 illustrates two different pre-defined position settings that may be stored for the implement 32.

As shown in FIG. 3, in one embodiment, the controller 102 may include a first loader position 140 (indicated by the solid lines) and a second loader position 142 (indicated by the dashed lines) stored within its memory 106 corresponding to pre-defined position settings for the loader arms 36. Specifically, as shown in the illustrated embodiment, a reference point defined on the loader arms 36 (e.g., the forward pivot point 42) may be located at a first height 144 above the vehicle's driving surface 34 when the loader arms 36 are moved to the first loader position 140 and at a second height 146 above the vehicle's driving surface 34 when the loader arms 36 are moved to the second loader position 142. In such an embodiment, the first height 144 may be selected, for example, such that the forward pivot point 42 is located generally adjacent to the vehicle's driving surface 34, thereby providing a suitable loader arm position (e.g., a return-to-travel position) when it is desired to move the work vehicle 10 along the driving surface 34 at a relatively high speed. Similarly, as shown in FIG. 3, the second height 146 may be selected, for example, such that the forward pivot point 42 is spaced apart significantly from the vehicle's driving surface 34, thereby providing a suitable loader arm position (e.g., a return-to-height position) when performing vehicle operations that require increased loader arm height (e.g., when dumping material into a truck bed).

It should be appreciated that the specific loader arm positions 140, 142 shown in FIG. 3 are simply provided as examples of suitable positions that may be stored within the controller's memory 106 as pre-defined loader arm position settings. In other embodiments, the first and second heights 144, 146 may be selected such that the forward pivot point 42 is located at any other suitable height relative to the vehicle's driving surface 34 when the loader arms 36 are moved to each respective position 140, 142. Additionally, it should be appreciated that, although two loader arm positions 140, 142 are shown in FIG. 3, any number of pre-defined loader position settings may be stored within the controller's memory 106, such as a single position setting or three or more position settings.

Similarly, as shown in FIG. 4, in one embodiment, the controller 102 may include a first implement position 150 (indicated by the solid lines) and a second implement position 152 (indicated by the dashed lines) stored within its memory 106 corresponding to pre-defined position settings for the vehicle's implement 32. Specifically, as shown in the illustrated embodiment, the implement 32 may be oriented at a given angular orientation when moved to the first implement position 150 so as to define a first angle 154 relative to parallel (or relative to the vehicle's driving surface 34). Additionally, the implement 32 may be oriented at a different angular orientation when moved to the second implement position 152 so as to define a second angle 156 relative to parallel (or relative to the vehicle's driving surface 34). In such an embodiment, the first angle 154 may be selected, for example, such that the implement 32 is oriented at a desirable position (e.g., a return-to-dig position) relative to the vehicle's driving surface 34 for performing a digging or scooping operation. Similarly, as shown in FIG. 4, the second angle 156 may be selected, for example, such that the implement 32 is oriented at a desirable position (e.g., a return-to-dump position) relative to the vehicle's driving surface 34 for performing a dumping operation. It should be appreciated that, in the illustrated embodiment, the angles 154, 156 associated with the angular orientation of the implement 32 have been defined relative to a bottom, planar surface 158 of the implement 32. However, in other embodiments, the angular orientation of the implement 32 may be defined relative to any other reference point on the implement 32.

It should be appreciated that the specific implement positions 150, 152 shown in FIG. 4 are simply provided as examples of suitable positions that may be stored within the controller's memory 106 as pre-defined implement position settings. In other embodiments, the angular orientations associated with the first and second angles 154, 156 may be selected such that the implement 32 is positioned at any other suitable orientation relative to the vehicle's driving surface 32 when it is moved to each respective implement position 150, 152. Additionally, it should be appreciated that, although two implement positions 150, 152 are shown in FIG. 4, any number of pre-defined implement position settings may be stored within the controller's memory 106, such as a single position setting or three or more position settings.

As indicated above, in several embodiments, the controller 102 may be configured to automatically control the operation of the various hydraulic components of the lift assembly 30 such that the loader arms 36 and/or the implement 32 are moved to one of the pre-defined positions upon the receipt of an operator input selecting such position. In doing so, the manner in which the hydraulic components are commanded to operate may vary depending on the position of the loader arms 36 and/or the implement 32 relative to the operator-selected position.

Figure 5:
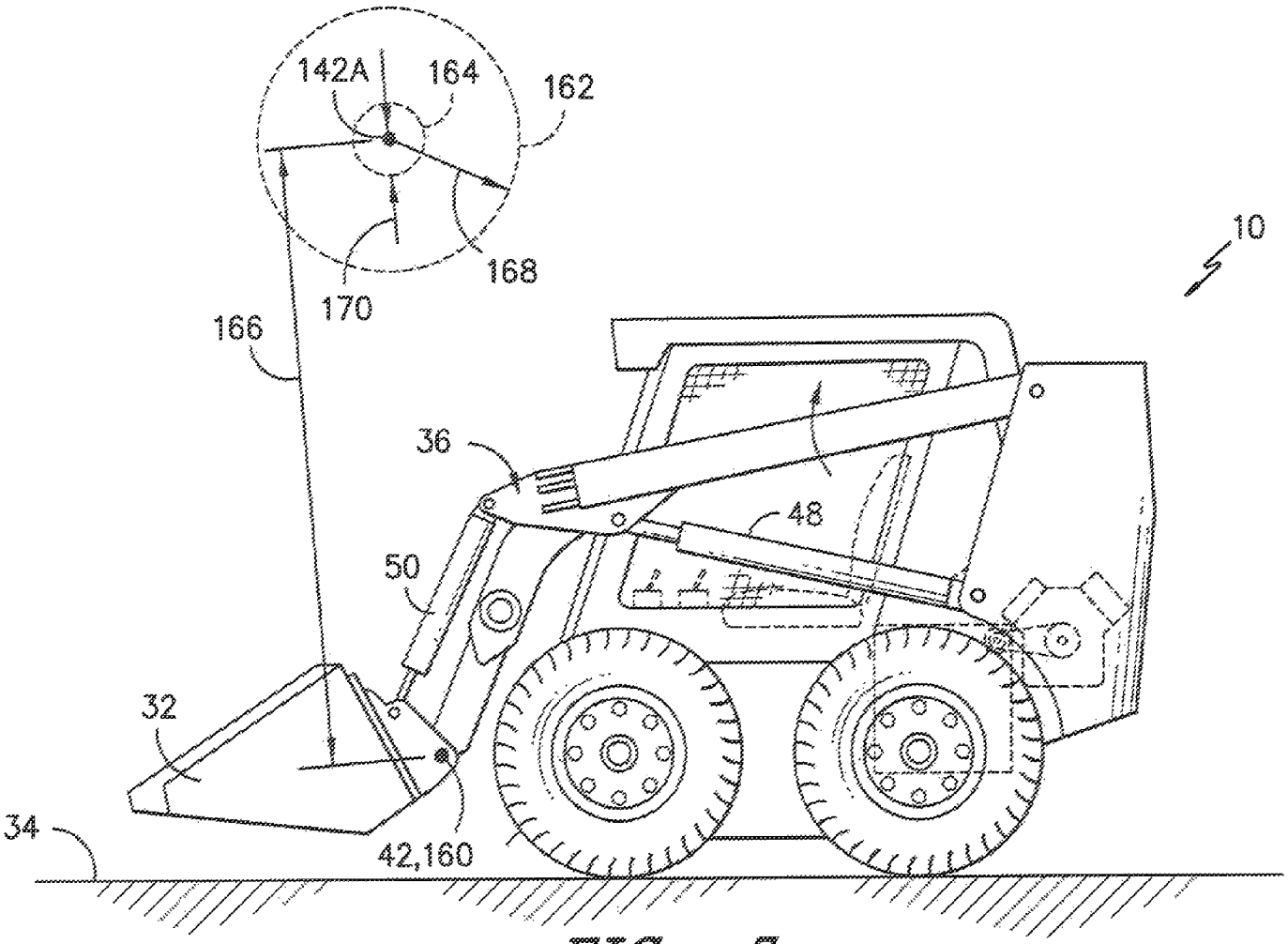
FIG. 5 illustrates yet another side view of the work vehicle shown in FIG. 1, particularly illustrating outer and inner threshold boundaries defined around a reference location associated with a pre-defined position for the loader arms.

For instance, an example of a specific control strategy that may be utilized when moving the loader arms 36 to one of their pre-defined positions will be described below with reference to FIG. 5. Specifically, for purposes of describing the control strategy, it may be assumed in the illustrated example that the operator has provided an operator input instructing the vehicle's controller 102 to move the loader arms 36 from their current position as shown in FIG. 5) to the second loader position 142 described above with reference to FIG. 3. As shown, the second loader position 142 is represented in FIG. 5 as reference location 142A, which corresponds to the specific location to which a given reference point 160 on the loader arms 36 must be moved in order to properly position the loader arms 36 at the operator-selected position 142. In the illustrated embodiment, the reference point 160 corresponds to the forward pivot point 42 defined at the pivot joint coupling the loader arms 36 to the implement 32. However, in other embodiments, the reference point 160 may be defined at any other suitable location on the loader arms 36.

In several embodiments, the controller 102 may be configured to vary the manner in which the hydraulic components for the loader arms 36 are operated based on a position error or distance 166 defined between the reference point 160 and the reference location 142A associated with the operator-selected position. For example, as shown in FIG. 5, both an outer threshold boundary 162 and an inner threshold boundary 164 may be defined relative to the reference location 142A. In such an embodiment, the boundaries 162, 164 may be used to identify threshold distances at which the operation of the lift valve(s) 108, 110 and corresponding lift cylinders 48 will be varied as the loader arms 36 are moved towards the operator-selected position. For example, as will be described below, while the reference point 160 defined on the loader arms 36 is located outside the outer threshold boundary 162, the controller 102 may be configured to transmit suitable control commands to the lift valve(s) 108, 110 associated with moving the loader arms 36 at a constant, high-end velocity. However, as the reference point 160 is moved across the outer threshold boundary 162 and into the area defined between the outer and inner boundaries 162, 164, the movement velocity of the loader arms 36 may be ramped down as a function of the remaining distance 166 defined between the reference point 160 and the reference location 142A. Thereafter, when the reference point 160 is eventually moved to a location within the inner threshold boundary 164, it may be assumed that the reference point 160 is positioned at the reference location 142A, at which time the movement of the loader arms 36 may be terminated.

It should be appreciated that the outer and inner threshold boundaries 162, 164 may generally correspond to any suitable control boundaries defined relative to the reference location 142A. For example, as shown in FIG. 5, the threshold boundaries 162, 164 correspond to concentric circles centered at the reference location 142A, with the outer threshold boundary 162 defining a first radius 168 and the inner threshold boundary 164 defining a second radius 170. In such an embodiment, the first radius 168 may correspond to the threshold distance at which the control strategy for the loader arms 36 transitions from maintaining the movement velocity constant (i.e., when the distance 166 is greater than the first radius 168) to ramping down the movement velocity of the loader arms 6 (i.e., when the distance 166 is less than the first radius 168 and greater than the second radius 170). Similarly, the second radius 170 may correspond to the threshold distance at which the movement of the loader arms 26 is terminated (i.e., when the distance 166 is less than the second radius 170). However, in other embodiments, the outer and inner threshold boundaries 162, 164 may define control boundaries relative to the reference location 142A having any other suitable shape.

It should also be appreciated that the specific threshold distances associated with the outer and inner threshold boundaries 162, 164 may generally vary from vehicle-to-vehicle based on any number of different parameters/factors. Specifically, in several embodiments, the threshold distance associated with the outer threshold boundary 162 may be selected based on the capabilities of the vehicle's hydraulic system as well as any combination of vehicle-specific parameters that may impact the performance of the various hydraulic system components. For instance, in one embodiment, the threshold distance associated with the outer threshold boundary 162 may be selected based on vehicle parameters including, but not limited to, the loader geometry, the inertia of the vehicle 10, the current vehicle load, the vehicle's rated load, the current engine speed, the size of the vehicle's hydraulic pump, the size of the various hydraulic cylinders 48, 50 and/or the like. Similarly, in several embodiments, the threshold distance associated with the inner threshold boundary 164 may be selected based on the bandwidth or responsiveness of the vehicle's hydraulic system, which may be a function of the lag time or control error associated with controlling the operation of the various electronic and mechanical components of the hydraulic system. In such embodiments, as the system responsiveness is increased (and, thus, system lag is decreased), the threshold distance associated with the inner threshold boundary 164 may be correspondingly decreased to indicate the reduced control error within the system.

Figure 6:
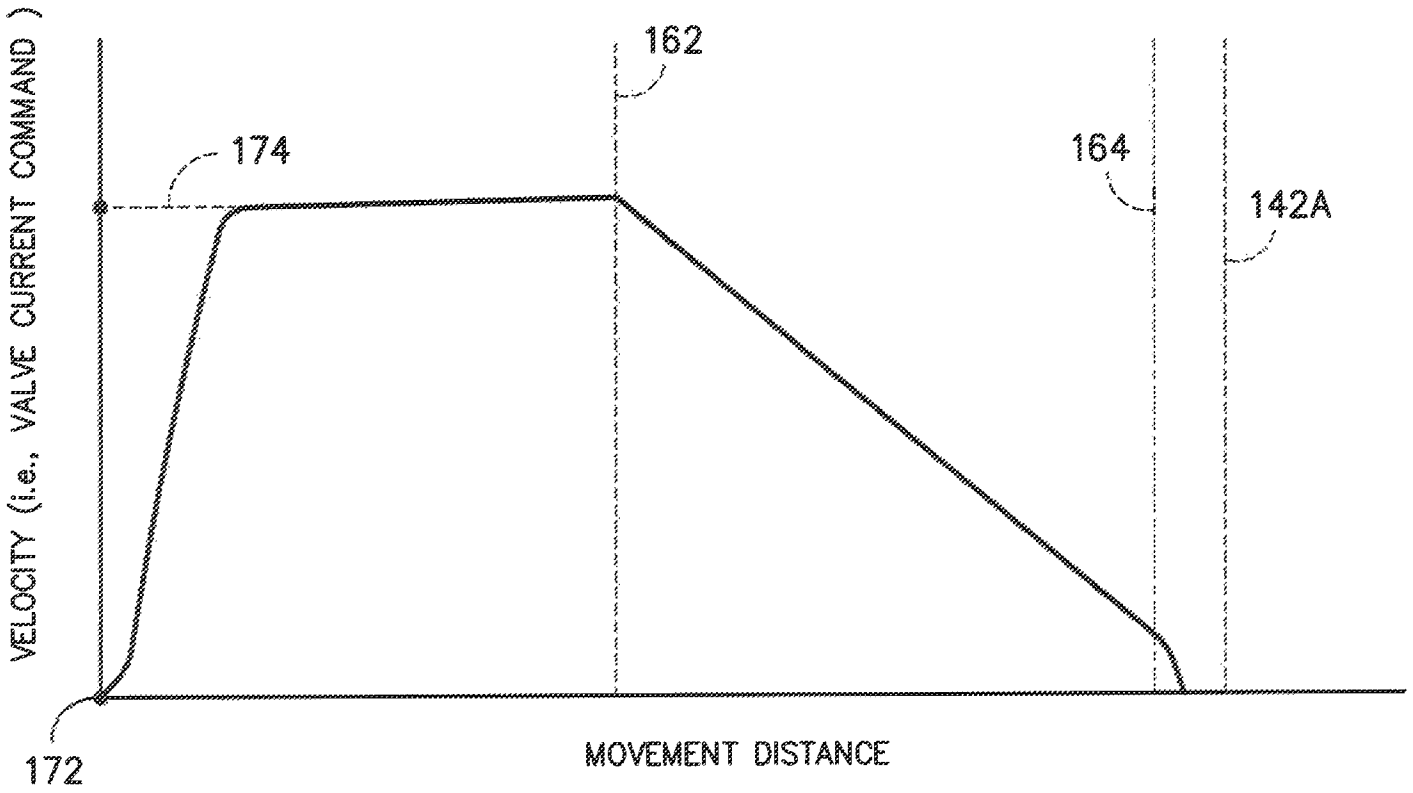
FIG. 6 illustrates an example graphical representation of a suitable velocity profile that may be used in accordance with aspects of the present subject matter when moving the loader arms and/or the implement to one of its pre-defined positions.

Referring now to FIG. 6, a graphical representation of the control strategy described above with reference to FIG. 5 is illustrated in accordance with aspects of the present subject matter. Specifically, FIG. 6 provides an example velocity profile graph illustrating how the movement velocity of the loader arms 36 (y-axis) may be varied as the loader arms 36 are moved across a given distance (x-axis) towards the pre-defined position selected by the operator. For example, the distance plotted along the x-axis may correspond to the distance 166 defined between the reference point 160 and the reference location 142A shown in FIG. 5. Thus, as the reference point 160 is moved from its initial position (at x=0) towards the reference location 142A, the velocity profile illustrated in FIG. 6 provides a representation of how the movement velocity may be changed as the corresponding distance 166 is reduced.

As shown in FIG. 6, upon the receipt of an operator input (e.g., at point 172) instructing the controller 102 to move the loader arms 36 to a pre-defined position, the controller 102 may be configured to control the operation of the lift valve(s) 108, 110 such that the movement velocity of the loader arms is ramped-up over a period of time from zero velocity to a high-end velocity 174. The ramp-up period may generally be provided to avoid jerkiness in the motion of the loader arms 36 as the loader arms are brought up to the speed. Thus, it should be appreciated that the rate at which the movement velocity is increased during the ramp-up period may generally be selected based on the configuration of the lift assembly 30 and the capabilities of the vehicle's hydraulic system in order to allow for smooth motion of the loader arms 36 during such period.

Additionally, it should be appreciated that, in several embodiments, the velocity associated with the high-end velocity 174 may also be selected so as to provide for smooth motion of the loader arms. For example, in one embodiment, the high-end velocity 174 may be selected as the maximum velocity at which the loader arms 36 may be moved without causing significant jerkiness, which may correspond to the absolute maximum velocity at which the loader arms 36 may be moved given the capabilities of the vehicle's hydraulic system (e.g., when the vehicle 10 is not loaded) or to a velocity that is less than the absolute maximum velocity for the loader arms 36.

As shown in FIG. 6, once the desired velocity is achieved, the movement velocity of the loader arms 36 may be maintained constant at the high-end velocity 174 until the reference point 160 associated with the loader arms 36 is moved within the outer threshold boundary (indicated by line 162), at which point the controller 102 may be configured to control the operation of the lift valve(s) 108, 110 such that the velocity of the loader arms 36 is ramped down as a function of the distance remaining between the reference point 160 and the reference location 142A. For example, as shown in FIG. 6, the movement velocity may be ramped according to a linear function as the reference point 160 is moved closer to the reference location 142A. However, in other embodiments, the movement velocity may be ramped down according to any other suitable function that allows for the velocity of the loader arms 36 to be reduced as the reference point 160 is moved closer to the desired reference location 142A.

Additionally, as shown in FIG. 6, as the reference point 160 is moved even closer to the reference location 142A and crosses over the inner threshold boundary (indicated by line 164), the controller 102 may be configured to control the operation of the lift valve(s) 108, 110 such that the movement velocity of the loader arms 36 is reduced to zero, thereby stopping movement of the loader arms 36. For example, as shown in the illustrated embodiment, the movement velocity may be immediately ramped down as the reference point 160 crosses over the inner threshold boundary 164. It should be appreciated that, since the inner threshold boundary 164 is defined based on the resolution or control error within the system, the distance between the boundary 164 and the reference location 142A will be relatively small. Thus, once the reference point 160 is moved to a location within the inner threshold boundary 164, it can be assumed for control purposes that the reference point 160 is now located at the reference location 142A associated with the pre-defined position selected by the operator.

Figure 7:
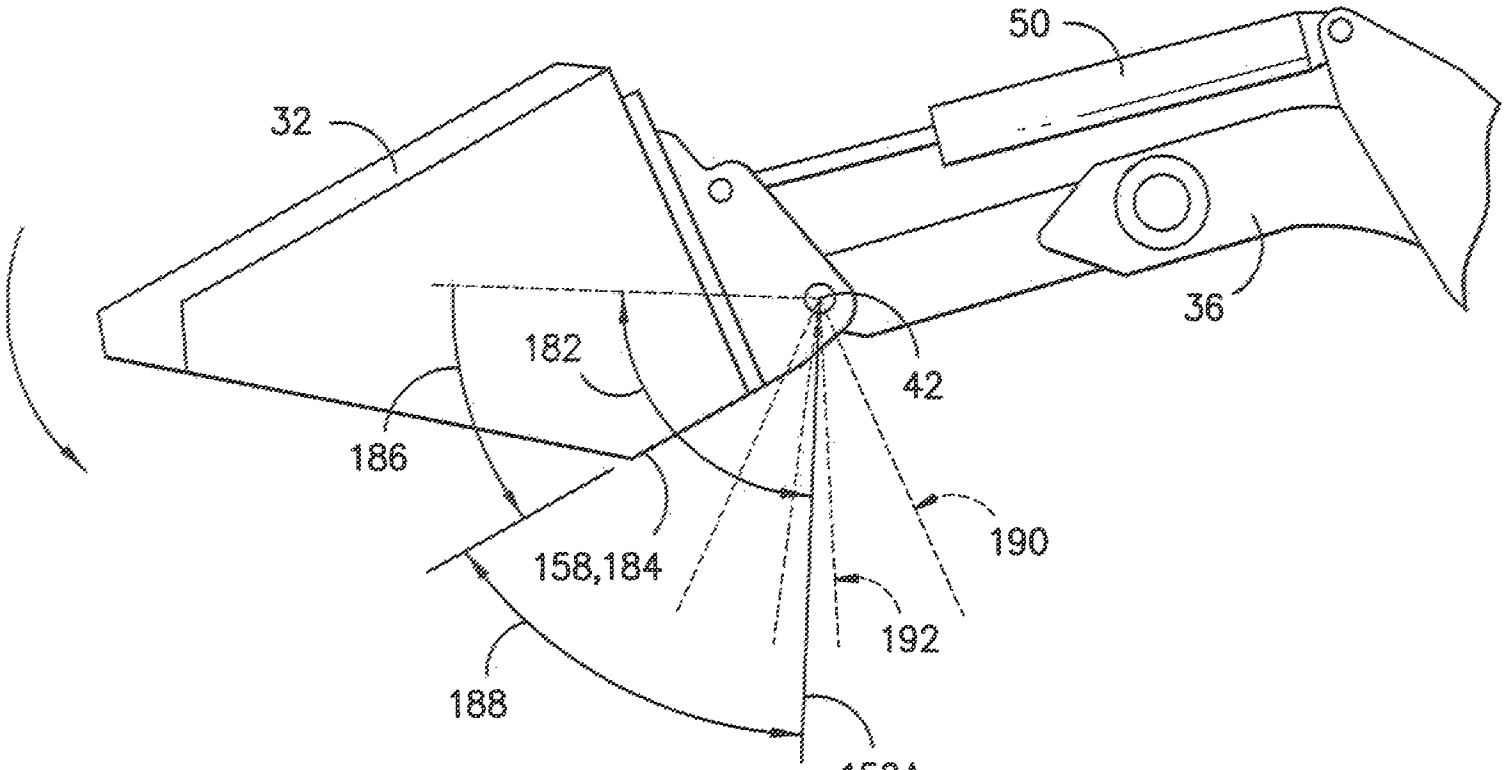
FIG. 7 illustrates another side view of the implement shown in FIG. 4, outer and inner threshold boundaries defined around a reference location associated with a pre-defined position for the implement.

It should be appreciated that a similar control strategy may be used in connection with automatically controlling the movement of the implement 32 in accordance with aspects of the present subject matter. For instance, an example of a specific control strategy that may be utilized when moving the implement 32 to one of its pre-defined positions will be described below with reference FIG. 7. Specifically, for purposes of describing the control strategy, it may be assumed that the operator has provided an operator input instructing the vehicle's controller 102 to move the implement 32 from its current position (as shown in FIG. 7) to the second implement position 152 described above with reference to FIG. 4. As shown, the second implement position 142 is represented in FIG. 7 as an angular reference location 152A defining a desired angle 182 relative to parallel (or relative to the vehicle's driving surface 34), which corresponds to the angular orientation to which a given reference point 184 on the implement 32 must be moved in order to properly position the implement 32 at the operator-selected position. In the illustrated embodiment, the reference point 184 corresponds to a location on the bottom, planar surface 158 of the implement 32. In such an embodiment, to properly position the implement 32 at the operator-selected position, the angular orientation of the implement 32 must be adjusted such that the bottom surface 158 of the implement 32 is aligned with the reference location 152A (i.e., such that a reference angle 186 defined relative to the bottom surface 158 matches (or may be assumed to match) the desired angle 182). However, in other embodiments, the reference point 184 may be defined at any other suitable location on the implement.

Similar to the control strategy described above with reference to FIGS. 5 and 6, the controller 102 may be configured to vary the manner in which the hydraulic components for the implement 32 are operated based on a position error or angular offset 188 defined between the reference point 184 and the reference location 152A associated with the operator-selected position. For example, as shown in FIG. 7, both an outer threshold boundary 190 and an inner threshold boundary 192 may be defined relative to the reference location 152A. In such an embodiment, the boundaries 190, 192 may be used to identify threshold angular ranges at which the operation of the tilt valve(s) 116, 118 and corresponding tilt cylinders 50 will be varied as the implement 32 moved to the operator-selected position. For example, while the implement 32 is positioned at an angular orientation such that the reference angle 186 defined relative the reference point 184 does not fall within the angular range defined by the outer threshold boundary 190, the controller 102 may be configured to transmit suitable control commands to the tilt valve(s) 116, 118 associated with moving the implement 32 at a constant, high-end velocity. However, as the implement 32 is rotated closer to the operator-selected position such that the reference angle 186 falls within the angular range defined between the outer and inner threshold boundaries 190, 192, the movement velocity of the implement 32 may be ramped down as a function of the remaining angular offset 188 defined between the reference angle 186 and the desired angle 182. Thereafter, once the implement 32 is rotated further such that the reference angle 186 falls within the angular range defined by the inner threshold boundary 192, it may be assumed that the reference point 184 is located at the reference location 152A, at which time the movement of the implement 32 may be terminated.

Given such a control strategy, it should be appreciated that the velocity profile for the implement 32 may be the same as or similar to the velocity profile shown in FIG. 6 for the loader arms 36 as the implement 32 is being moved from its current position to the operator-selected, pre-defined position. For example, similar to that shown in FIG. 6, the movement velocity of the implement 32 may be initially ramped-up to a desired high-end velocity during an initial ramp-up time period. The movement velocity may then be maintained at the high-end velocity until the reference location 184 is moved within the outer threshold boundary 190, at which point the velocity may be ramped-down as a function of the remaining angular offset 188. Thereafter, once the reference point 184 associated with the implement 32 is moved within the inner threshold boundary 192, the movement of the implement 32 may be terminated.

Figure 8:
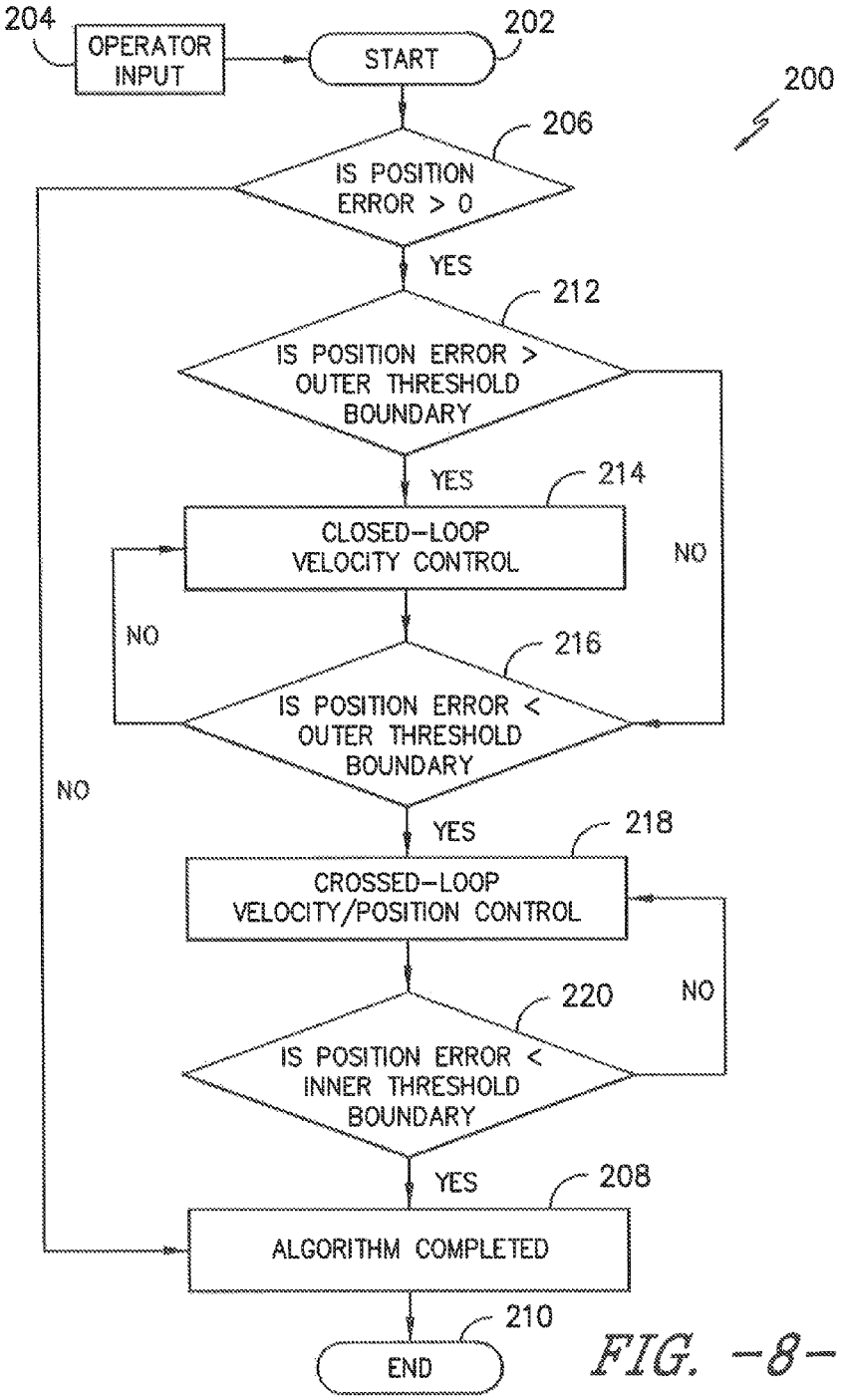
FIG. 8 illustrates a flow diagram of one embodiment of a closed-loop control algorithm that may be utilized in accordance with aspects of the present subject matter to automatically control the position of the loader arms and/or the implement.

Referring now to FIG. 8, one embodiment of a control method 200 that may be utilized by a vehicle controller to implement the control strategies described above with reference to FIGS. 5-7 is illustrated in accordance with aspects of the present subject matter. In particular, FIG. 8 illustrates a closed-loop control algorithm that utilizes closed-loop velocity control to maintain the movement velocity of the loader arms 36 and/or the implement 32 constant when the reference point(s) defined for such component(s) is located outside the corresponding outer threshold boundary. Thereafter, when the reference point(s) is moved within the outer threshold boundary (but is still outside the inner threshold boundary), the closed-loop control algorithm utilizes closed-loop velocity control or closed-loop position control to regulate the operation of the hydraulic components associated with the loader arms 36 and/or the implement 32 as the movement velocity of such component(s) is ramped down to zero.

In general, the method 200 will be described herein with reference to implementing the closed-loop control algorithm to automatically control the operation of the lift valve(s) 108, 110 and associated lift cylinders 48 as the loader arms 36 are being moved from their current to a pre-defined position selected by the operator. However, it should be appreciated that the same algorithm may be applied to automatically control the operation of the tilt valve(s) 116, 118 and associated tilt cylinders 50 as the implement 32 is being moved from its current to a pre-defined position selected by the operator. It should also be appreciated that, in instances in which the operator has commanded that the controller 102 simultaneously move both the loader arms 36 to one of their pre-defined positions and the implement 32 to one of its pre-defined positions, the closed-loop control algorithm shown in FIG. 8 may be implemented simultaneously (but separately) fix the loader arms 36 and the implement 32. For instance, when performing a material moving operation, the operator may instruct the controller 102 to automatically move both the loader arms 36 to the second loader position 142 shown in FIG. 3 (e.g., a return-to-height position) and the implement 32 to the second implement position shown in FIG. 4 (a return-to-dump position) to allow the lift assembly 30 to be appropriately positioned for dumping material into the back of a truck. In such instance, the closed-loop control algorithm may be implemented for both the loader arms 36 and the implement 32 along separate circuits to properly control the loader arms/implement 36, 32 as such components are moved to their respective selected positions.

At (202), the algorithm may be initiated upon the receipt of a suitable operator input 204 instructing the controller 102 to move the loader arms 36 to one of their pre-defined positions. In general, the human-machine interface for the work vehicle 10 may be designed such that the operator may utilize any suitable input device(s) and/or perform any suitable action(s) to generate the operator input 204 for initiating the algorithm. However, in a particular embodiment of the present subject matter, the operator may initially instruct the controller 102 to go into a return-to position mode (e.g., by providing an operator input using a button, switch or other suitable input device 130 housed within the cab 20, such as the same button/switch used to initiate the learning mode described above). The operator may then press and hold a separate button, switch or trigger to temporarily deactivate all lift assembly functionality while the lift/tilt joystick 25 is moved in the direction in which it would need to be adjusted to manually, move the loader arms to the desired pre-defined position. The controller may then identify the pre-defined position and subsequently initiate the disclosed algorithm. For example, if it is desired to move the loader arms to the second loader position 142 shown in FIG. 3, the lift/tilt joystick 25 may be moved in a direction to simulate rotating the loader arms 36 upward about the rear pivot point 46.

As shown in FIG. 8, upon initiation of the algorithm, the controller 102 may, at (206), be configured to compare the current position of the loader arms 36 to the operator-selected position. For example, in several embodiments, the controller 102 may be configured to determine a position error for the loader arms 36 corresponding to the difference between the current position of a reference point defined on the loader arms 36 (e.g., the forward pivot point 42) and a reference location associated with the operator-selected position (e.g., the location at which the reference point should be positioned when the loader arms 36 are moved to the operator-selected position). For instance, as described above with reference to FIG. 5, the position error may correspond to the distance 166 define between the reference point 160 and the reference location 142A. If the position error is equal to zero (i.e., the loader arms 36 are already located at the operator-selected position), the controller may, at (208), indicate that the closed-loop control algorithm is completed and thereafter, at (210), terminate implantation of the algorithm.

However, if the position error is greater than zero (thereby indicating that the loader arms 36 need to be moved), the controller 102 may, at (212), determine whether the position error is greater than the threshold parameter associated with the corresponding outer threshold boundary. Specifically, in several embodiments, the controller 102 may be configured to determine whether the distance between the reference point defined on the loader arms 36 and the reference location associated with the operator-selected position is greater than the threshold distance associated with the outer threshold boundary. If so, at (214), the controller 102 may be configured to utilize a closed-loop velocity control sub-algorithm (described below with reference to FIG. 9) in order to control the operation of the lift valve(s) 108, 110 in a manner that causes the loader arms to be moved at a constant, high-end velocity. However, if the reference point is not located outside the outer threshold boundary, the control algorithm may move forward to control step (216).

Figure 9:
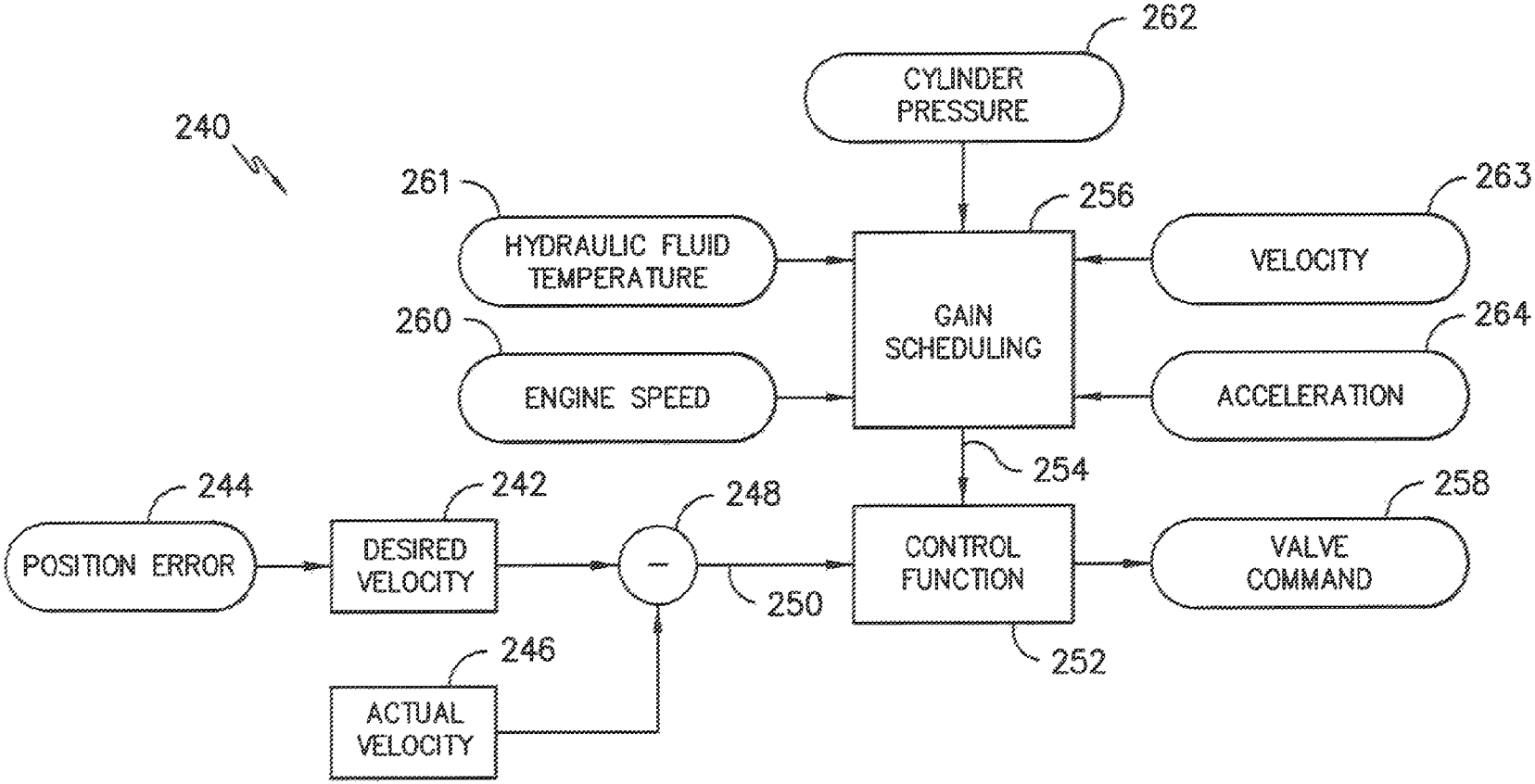
FIG. 9 illustrates a flow diagram of one embodiment of a closed-loop velocity control sub-algorithm that may be implemented in accordance with aspects of the present subject matter.

An example of a suitable closed-loop velocity control sub-algorithm 240 that may be utilized at (214) to control the operation of the lift valve(s) 108, 110 is shown in FIG. 9. As shown, in several embodiments, a desired velocity 242 for the loader arms 36 may be initially determined based on the current position error associated with the loader arms 36 (indicated by box 244). For example, as indicated above, the desired velocity for the loader arms 36 may be set as a constant, high-end velocity when the reference point defined on the loader arms 36 is located outside the outer threshold boundary. Thus, when the position error 244 indicates that the reference point is located outside the outer threshold boundary, the desired velocity 242 selected for the loader arms 36 may correspond to the desired high-end velocity.

The desired velocity 242 may then be compared to an actual, monitored velocity 246 of the loader arms 36 (e.g., via a difference block 248) to generate a velocity error signal 250. As shown in FIG. 9, the velocity error signal 250 may then be input into a control function block 252 along with one or more control gain signals 254 received from a gain scheduling block 256. Based on such signals 250, 254, the control function block 252 may output an appropriate valve command(s) 258 for controlling the operation of the lift valve(s) 108, 110 so that the corresponding lift cylinders 48 are actuated in a manner that drives the movement velocity of the loader arms 36 to the desired velocity. For example, the control function block 252 may be configured to implement a proportional-integral-derivative (PID) feedback mechanism that utilizes the velocity error signal 250 along with suitable gain signals 254 (e.g., a proportional gain signal, an integral gain signal and a derivative gain signal) to control the lift valve(s) 108, 110 in a manner that minimizes the error between the desired velocity 242 and the actual velocity 246. Alternatively, the control function block 252 may be configured to implement any other suitable control-loop feedback mechanism, such as a proportional-integral (PI) feedback mechanism.

It should be appreciated that the actual velocity of the loader arms 36 may be monitored using any suitable speed sensor(s) configured to directly monitor the speed of the loader arms 36 and/or using any other suitable sensor(s) that allows for such velocity to be indirectly monitored. For instance, as indicated above, the controller 102 may be communicatively coupled to one or more position sensors 132 for monitoring the position of the loader arms 36. In such instance, by monitoring the change in position of the loader arms 36 over time, the movement velocity of the loader arms 36 may be estimated or calculated. For example, if the position sensor(s) 132 provides measurement signals corresponding to the position of the loader arms 36 at a given sampling frequency (e.g., every 100 milliseconds), the movement velocity of the loader arms 36 may be calculated by determining the change in position of the loader arms 36 between the last two position measurements and by dividing the difference by the time interval existing between such measurements.

It should also be appreciated that the control gain(s) 254 input into the control function block 254 may be determined by the gain scheduling block 256 based on any suitable vehicle parameter or combination of vehicle parameters that may impact the responsiveness of the hydraulic system components. For example, as shown in FIG. 9, in one embodiment, the control gain(s) 254 may be calculated based on a first input signal 260 associated with the engine speed (e.g., in RPMs), a second input signal 261 associated with the temperature of the hydraulic fluid contained within the hydraulic system, a third input signal 262 associated with the pressure of the hydraulic fluid supplied within the various hydraulic cylinders, a fourth input signal 263 associated with the actual velocity of the loader arms 36 and/or a fifth input signal associated with the acceleration of the loader arms 36. However, in other embodiments, the control gain(s) 254 may be calculated based on any other combination of input signals, including any other combination of the various input signals 260-264 shown in FIG. 9.

Additionally, it should be appreciated that, when implementing the closed-loop velocity control sub-algorithm 240, the controller 102 may be configured to initially ramp-up the movement velocity of the loader arms 36 so as to avoid jerkiness in the loader arm motion. For example, the desired velocity 242 may initially be ramped-up over a given time period similar to that shown in FIG. 6. Thereafter, the controller 102 may then set the desired velocity 242 to the desired, high-end velocity.

Referring back to FIG. 8, for each iteration of the closed-loop velocity control sub-algorithm 240 executed at (214), the position error associated with the loader arms 36 may, at (216), be monitored with reference to the outer threshold boundary. In doing so, if the reference point defined on the loader arms 36 is still positioned outside the outer threshold boundary, the closed-loop velocity control sub-algorithm 240 may continue to be implemented so as to maintain the movement velocity of the loader arms 36 at the desired, high-end velocity. However, once the reference point is moved to a position within the outer threshold boundary, the closed-loop control algorithm may transition to a ramp-down phase of the control methodology (at (218)) in which the algorithm utilizes either a closed-loop velocity control sub-algorithm or a closed-loop position control sub-algorithm to generate control commands for controlling the operation of the tilt valve(s) 108, 110 such that the movement velocity of the loader arms 36 is ramped-down as the loader arms 36 approach the pre-defined position selected by the operator.

In embodiments in which the control algorithm is configured to utilize closed-loop velocity control at (218), such control may be implemented in accordance with sub-algorithm 240 described above with reference to FIG. 9. However, instead of the desired velocity 242 corresponding to a constant, high-end velocity, the desired velocity 242 may correspond to a variable, ramp-down velocity that is decreased as the corresponding position error is reduced (i.e., as the reference point on the loader arms 36 moves closer to the reference location associated with the operator-selected position). For example, referring back to the velocity profile shown in FIG. 6, the ramp-down velocity may be defined based on a predetermined function (e.g., a linear function) that correlates the position error to the desired movement velocity of the loader arms 36. In such instance, a data or look-up table may be stored within the controller's memory 106 that provides a desired velocity for each position error defined between the outer threshold boundary and the inner threshold boundary. Once the current position error is determined, the controller 102 may that simply refer to the data/look-up table to determine the instantaneous desired velocity for the loader arms 36. Such velocity may then be compared to the actual velocity 246 for the loader arms 36 to generate the velocity error signal 250 that is input into the control function block 252.

Figure 10:
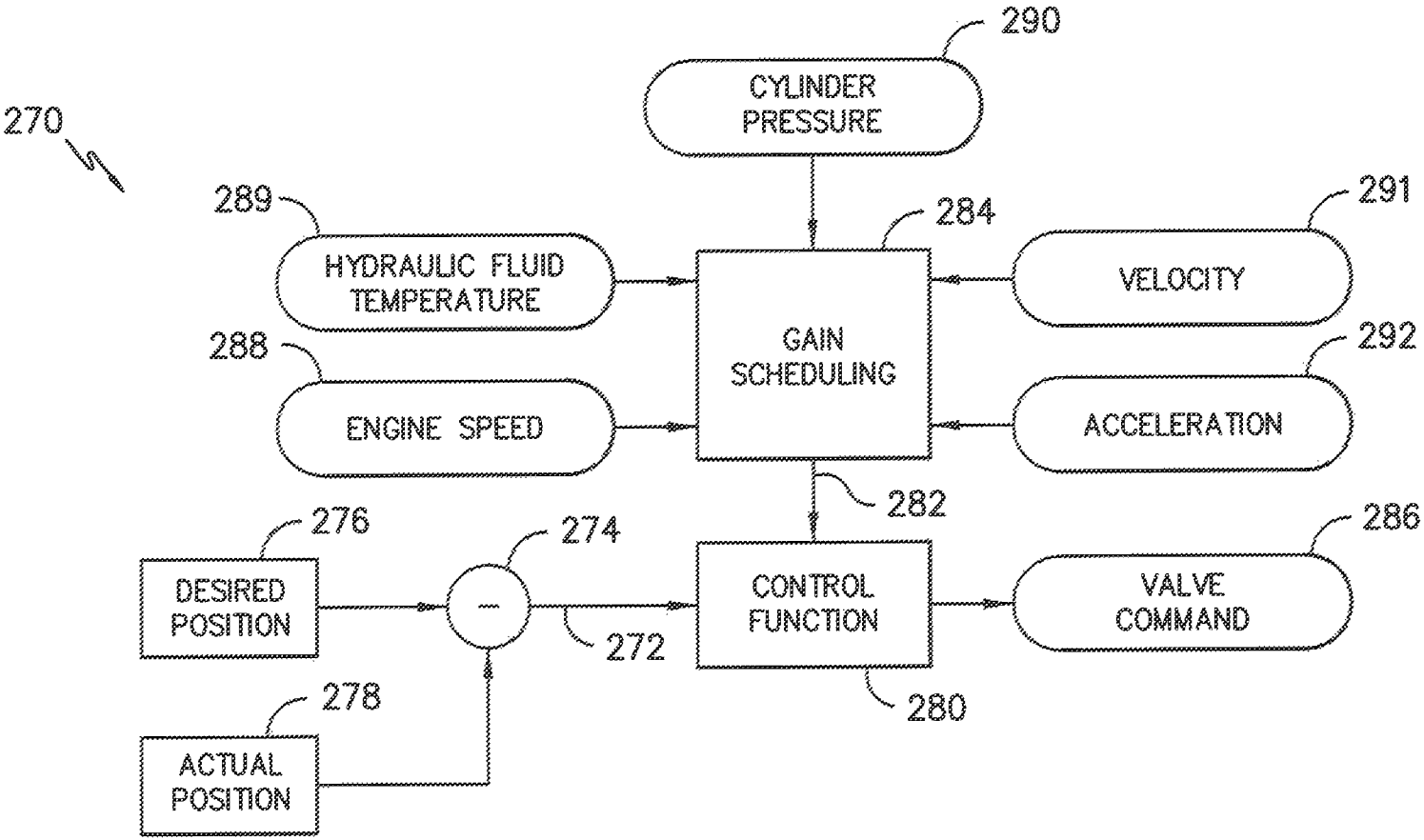
FIG. 10 illustrates a flow diagram of one embodiment of a closed-loop position control sub-algorithm that may be implemented in accordance with aspects of the present subject matter.

Alternatively, as indicated above with reference to FIG. 8, the control algorithm may instead be configured to utilize closed-loop position control at (218). In such instance, FIG. 10 illustrates one example of a suitable closed-loop position control sub-algorithm 270 that may be implemented at (218) in accordance with aspects of the present subject matter. As shown, a position error signal 272 may be generated by comparing (e.g., via a difference block 274) a desired position 276 for the loader arms 36 to the actual position of the loader arms 36 (indicated by box 278). In several embodiments, the position error signal 272 may correspond to the position error described above with reference to FIG. 8. For example, the desired position 276 may correspond to the reference location associated with the operator-selected position and the actual position 278 may correspond to the monitored position of the reference point defined on the loader arms 36. In such embodiments, by subtracting the desired position 276 from the actual position 278, the error position signal 272 may simply provide an indication of the distance that the reference point must be moved before the loader arms 36 are properly position at the pre-defined position selected by the operator.

Alternatively, the desired position 276 may correspond to a time-based position estimate for the loader arms 36. Specifically, for each iteration of the closed-loop position control sub-algorithm 270, the controller 102 may be configured to estimate the position at which the reference point should be located currently based on any number of factors, such as the current movement velocity and/or acceleration of the loader arms 36 and/or the previous control command(s) transmitted to the associated valve(s) 108, 110. Such estimated position may then be input into the difference block 274 as the desired position 276 and compared to the actual, monitored position 278 of the reference point in order to generate the position error signal 272.

As shown in FIG. 10, the position error signal 272 generated by the difference block 274 may then be input into a control function block 280 along with one or more control gain signals 282 received from a gain scheduling block 284. Based on such input signals 272, 282, the control function block 280 may output an appropriate valve command(s) 286 for controlling the operation of the lift valve(s) 108, 110 so that the corresponding lift cylinders 48 are actuated in a manner that drives the position of the loader arms 36 to the desired position. For example, the control function block 280 may be configured to implement a proportional-integral-derivative (PID) feedback mechanism that utilizes the position error signal 272 along with suitable gain signals 282 (e.g., a proportional gain signal, an integral gain signal and a derivative gain signal) to control the lift valve(s) 108, 110 in a manner that minimizes the error between the desired and actual positions 276, 278 of the loader arms 36. Alternatively, the control function block may be configured to implement any other suitable control-loop feedback mechanism, such as a proportional-integral (PI) feedback mechanism.

It should be appreciated that, similar to the control gain(s) 254 described above, the control gain(s) 282 input into the control function block 280 shown in FIG. 10 may be determined by the gain scheduling block 284 based on any suitable vehicle parameter or combination of vehicle parameters that may impact the responsiveness of the hydraulic system components. For example, as shown in FIG. 10, in one embodiment, the control gain(s) 282 may be calculated based on a first input signal 288 associated with the engine speed (e.g., in RPMs), a second input signal 289 associated with the temperature of the hydraulic fluid contained within the hydraulic system, a third input signal 290 associated with the pressure of the hydraulic fluid supplied within the hydraulic cylinders, a fourth input signal 291 associated with the velocity of the loader arms 36 and/or a fifth input signal 292 associated with the acceleration of the loader arms 36. However, in other embodiments, the control gain(s) 282 may be calculated based on any other combination of input signals, including any other combination of the various input signals 288-292 shown in FIG. 10.

Referring hack to FIG. 8, for each iteration of the velocity or position control sub-algorithm implemented at (218), the position error associated with the loader arms 36 may, at (220), be continuously monitored with reference to the inner threshold boundary. In doing so, if the reference point defined on the loader arms 36 is still positioned outside the inner threshold boundary, the relevant velocity or position control sub-algorithm may continue to be implemented. However, once the reference point is moved to a position within the inner threshold boundary, it may be assumed that the loader arms 36 have been properly moved to the pre-defined position selected by the operator, at which time the controller 102 may, at (208), indicate that the closed-loop control algorithm is completed and thereafter, at (210), terminate implantation of the algorithm.

As indicated above, the same algorithm described above with reference to FIG. 8 may also be utilized to control the operation of the tilt valve(s) 116, 118 when the implement 32 is being moved to one of its pre-defined position. In doing so, the position error associated with the implement 32 (i.e., the offset between the reference point defined on the implement and the reference location associated with the operator-selected position, such as the angular offset 188 shown in FIG. 7) may be continuously monitored to determine the position of the implement's reference point relative to the outer and inner threshold boundaries. If, at (212), the position error is greater than the outer threshold boundary, the closed-loop velocity control sub-algorithm shown in FIG. 9 may be implemented (at (214)) in order to maintain the movement velocity of the implement 32 at the desired, high-end velocity. Similarly, if, at (216), the position error is less than the outer threshold boundary but greater than the inner threshold boundary, the closed-loop velocity control sub-algorithm 240 shown in FIG. 9 or the closed-loop position control sub-algorithm 270 shown in FIG. 10 may be implemented (at 218) in order to control the operation of the tilt valve(s) 116, 118 in a manner that ramps-down the movement velocity of the implement 32 as it is moved closer to the operator-selected position. Thereafter, at (220), when the position error is less than the inner threshold boundary, the controller may, at (208), indicate that the closed-loop control algorithm is completed and thereafter, at (210), terminate implantation of the algorithm.

Figure 11:
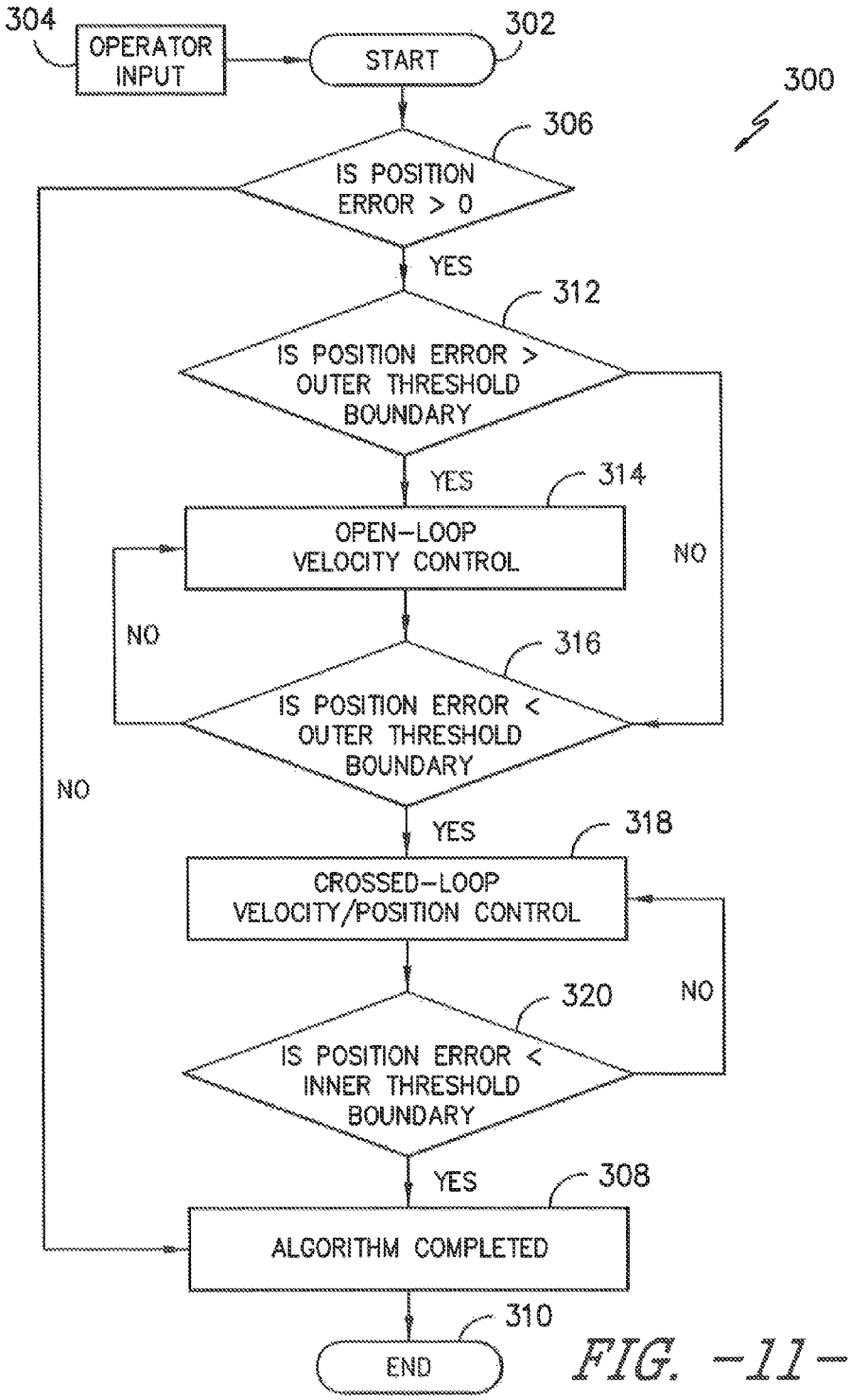
FIG. 11 illustrates a flow diagram of one embodiment of a semi-closed-loop control algorithm that may be utilized in accordance with aspects of the present subject matter to automatically control the position of the loader arms and/or the implement.

Referring now to FIG. 11, another embodiment of a control method 300 that may be utilized by a vehicle controller to implement the control strategies described above with reference to FIGS. 5-7 is illustrated in accordance with aspects of the present subject matter. In particular, FIG. 11 illustrates a semi-closed-loop control algorithm that utilizes open-loop velocity control to command a constant movement velocity for the loader arms 36 and/or the implement 32 when the reference point(s) associated with such component(s) is located outside the outer threshold boundary. Thereafter, when the reference point(s) is moved within the outer threshold boundary (but is still outside the inner threshold boundary), the semi-closed-loop control algorithm utilizes either a closed-loop velocity control sub-algorithm or a closed-loop position control sub-algorithm to regulate the operation of the hydraulic components associated with the loader arms 36 and/or the implement 32 as the movement velocity of such component(s) is ramped down.

In general, the method 300 will be described herein with reference to implementing the semi-closed-loop control algorithm to automatically control the operation of the lift valve(s) 108, 110 and associated lift cylinders 48 as the loader arms 36 are being moved from their current to a pre-defined position selected by the operator. However, it should be appreciated that the same algorithm may also be applied to automatically control the operation of the tilt valve(s) 116, 118 and associated tilt cylinders 50 as the implement 32 is being moved from its current to a pre-defined position selected by the operator.

As shown in FIG. 11, the various control steps included within the semi-closed-loop control algorithm are similar to the control steps included within the closed-loop control algorithm described above with reference to FIG. 8. For example, at (302), the algorithm may be initiated upon the receipt of a suitable operator input 304 instructing the controller 102 to move the loader arms 36 to one of their pre-defined positions. Thereafter, at (306), the controller 102 may be configured to compare the current position of the loader arms 36 to the operator-selected position. Specifically, if the position error associated with the loader arms 36 (i.e., difference between the current position of the reference point defined on the loader arms 36 and the reference location associated with the operator-selected position) is equal to zero, the controller 102 may, at (308) indicate that the semi-closed-loop control algorithm is completed and thereafter, at (310), terminate implantation of the algorithm. However, if the position error is greater than zero (thereby indicating that the loader arms 36 still need to be moved), the controller 102 may, at (312), determine whether the position error is greater than the threshold distance associated with the outer threshold boundary. If so, at (314), the controller 102 may be configured to utilize open-loop velocity control in order to command that the loader arms 36 be moved at constant, high-end velocity. However, if the reference point is located inside the outer threshold boundary, the control algorithm may move forward to control step (316)

It should be appreciated that, when implementing step (314), the controller 102 may be configured to initially ramp-up the movement velocity of the loader arms 36 so as to avoid jerkiness in the loader arm motion. For example, the movement velocity may be initially ramped-up over a given time period similar to that shown in FIG. 6. Thereafter, the controller 102 may be configured to transmit a suitable command signal(s) to the lift valve(s) 108, 110 in order to instruct the lift valve(s) 108, 110 to actuate the corresponding lift cylinders 48 in a manner that results in movement of the loader arms 36 at the desired, high-end velocity. In doing so, given the open-loop control, the command signal(s) transmitted by the controller 102 may be generated without any feedback associated with the actual movement velocity of the loader arms 36.

Referring still to FIG. 11, as the loader arms 36 are being commanded to be moved at the constant velocity, the position error associated with the loader arms 36 may, at (316) be continuously monitored with reference to the outer threshold boundary. If the reference point defined on the loader arms 36 is still positioned outside the outer threshold boundary, the open-loop velocity control may continue to be implemented. However, once the reference point is moved to a position within the outer threshold boundary, the semi-closed-loop control algorithm may transition to a ramp-down phase of the control methodology (at (318)) in which the algorithm utilizes either closed-loop velocity control or closed-loop position control to generate control commands for controlling the operation of the lift valve(s) 108, 110 such that the movement velocity of the loader arms 36 is ramped-down as the loader arms 36 approach the pre-defined position selected by the operator. As described above, such control may, for example, be implemented using the closed-loop velocity control sub-algorithm 240 shown in FIG. 9 or the closed-loop position control sub-algorithm 270 shown in FIG. 10.

For each iteration of the velocity control sub-algorithm or the position control sub-algorithm implemented at (318), the position error associated with the loader arms 36 may, at (320) be monitored with reference to the inner threshold boundary. In doing so, if the reference point defined on the loader arms 36 is still positioned outside the inner threshold boundary, the relevant control sub-algorithm may continue to be implemented. However, once the reference point is moved to a position within the inner threshold boundary, it may be assumed that the loader arms 36 have been properly moved to the pre-defined position selected by the operator, at which time the controller may, at (308) indicate that the semi-closed-loop control algorithm is completed and thereafter, at (310), terminate implantation of the algorithm.

As indicated above, the same algorithm shown in FIG. 11 may also be utilized to control the operation of the tilt valve(s) 116, 118 when the implement 32 is being moved to one of its pre-defined position. In doing so, the position error associated with the implement 32 (i.e., the offset between the reference point defined on the implement and the reference location associated with the operator-selected position, such as the angular offset 188 shown in FIG. 7) may be continuously monitored to determine the position of the reference point relative to the outer and inner threshold boundaries. If, at (312), the position error is greater than the outer threshold boundary, open-loop velocity control may be implemented (at 314) in order to command that the implement 32 be moved at the desired, high-end velocity. Similarly, if, at (316), the position error is less than the outer threshold boundary but greater than the inner threshold boundary, the closed-loop velocity control sub-algorithm 240 shown in FIG. 9 or the closed-loop position control sub-algorithm shown in FIG. 10 may be implemented (at 318)) in order to control the operation of the tilt valve(s) 115, 118 in a manner that ramps-down the movement velocity of the implement 32 as it is moved closer to the operator selected position. Thereafter, when the position error is less than the inner threshold boundary, the controller 102 may indicate, at (308), that the semi-closed-loop control algorithm is completed and thereafter, at (310), terminate implantation of the algorithm.

Figure 12:
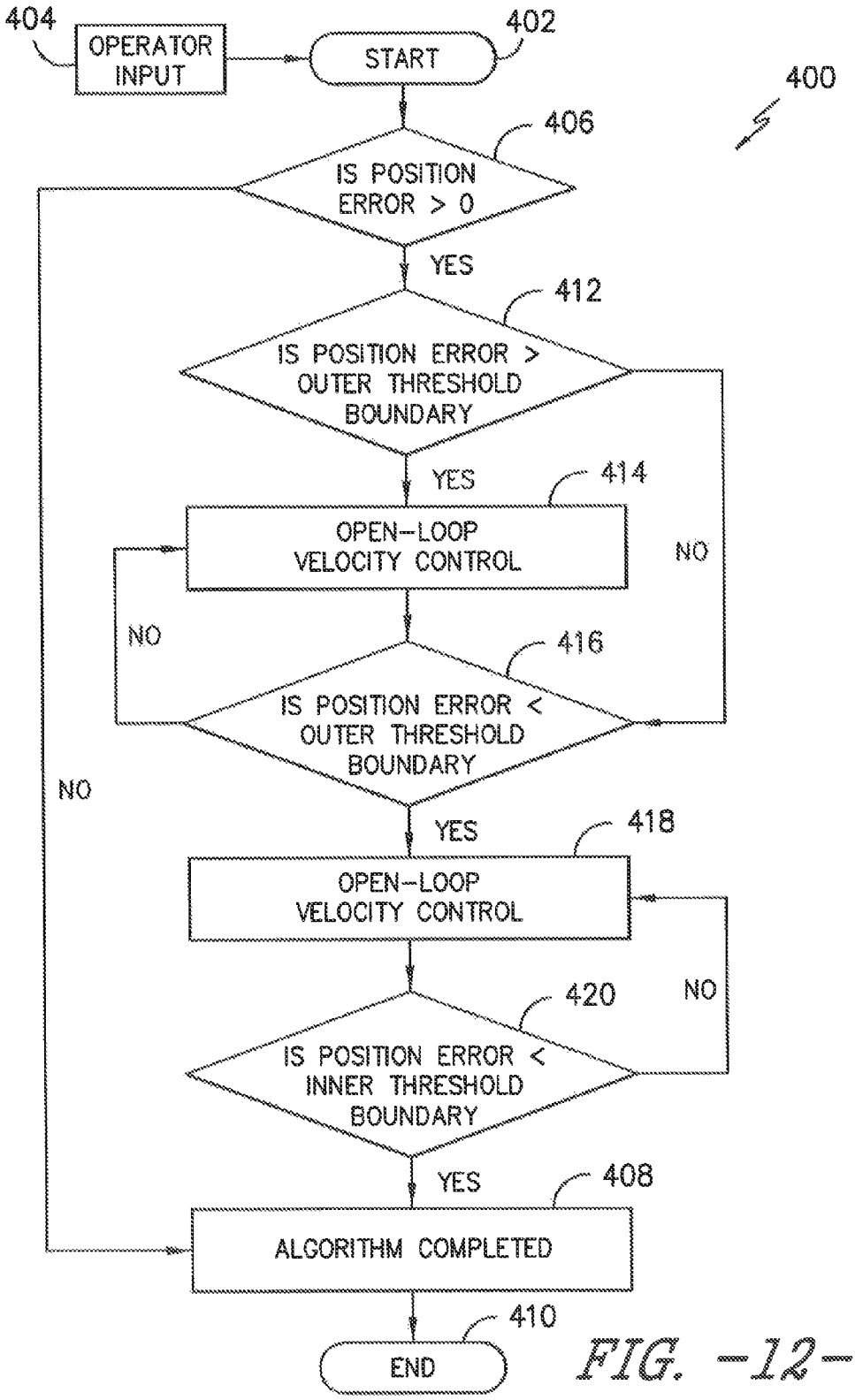
FIG. 12 illustrates a flow diagram of one embodiment of an open loop control algorithm that may be utilized in accordance with aspects of the present subject matter to automatically control the position of the loader arms and/or the implement.

Referring now to FIG. 12, a further embodiment of a control method 400 that may be utilized by a vehicle controller to implement the control strategies described above with reference to FIGS. 5-7 is illustrated in accordance with aspects of the present subject matter. In particular, FIG. 11 illustrates an open-loop control algorithm that utilizes open-loop velocity control to command both a constant movement velocity for the loader arms 36 and/or the implement 32 when the reference point(s) associated with such component(s) is located outside the outer threshold boundary and that the movement velocity be ramped down when the reference point(s) is eventually moved within the outer threshold boundary.

In general, the method 400 will be described herein with reference to implementing the open-loop control algorithm to automatically control the operation of the lift valve(s) 108, 110 and associated lift cylinders 48 as the loader arms 36 are being moved from their current to a pre-defined position selected by the operator. However, it should be appreciated that the same algorithm may be applied to automatically control the operation of the tilt valve(s) 116, 118 and associated tilt cylinders 50 as the implement 32 is being moved from its current to a pre-defined position selected by the operator.

As shown in FIG. 12, the various control steps included within the open-loop control algorithm are similar to the control steps included within the closed-loop and semi-closed-loop control algorithms described above with reference to FIGS. 8 and 11. For example, at (402), the algorithm may be initiated upon the receipt of a suitable operator input 404 instructing the controller 102 to move the loader arms to one of their pre-defined positions. Thereafter, at (406), the controller 102 may be configured to compare the current position of the loader arms 36 to the operator-selected position. Specifically, if the position error associated with the loader arms is equal to zero, the controller 102 may, at (408), indicate that the open-loop control algorithm is completed and thereafter, at (410), terminate implantation of the algorithm. However, if the position error is greater than zero (thereby indicating that the loader arms need to be moved), the controller may, at (412) determine whether the position error is greater than the threshold distance associated with the outer threshold boundary. If so, at (414), the controller 102 may be configured to utilize open-loop velocity control in order to command that the loader arms 36 be moved at a constant, high-end velocity. However, if the reference point is located within the outer threshold boundary, the control algorithm may move forward to control step (416).

It should be appreciated that, when implementing step (414), the controller 102 may be configured to initially ramp-up the movement velocity of the loader arms 36 so as to avoid jerkiness in the loader arm motion. For example, the movement velocity may be initially ramped-up over a given time period similar to that shown in FIG. 6. Thereafter, the controller 102 may be configured to transmit a suitable command signal(s) instructing the lift valve(s) 116, 118 to actuate the corresponding lift cylinders 48 in a manner that results in movement the loader arms 36 at the desired, high-end velocity.

Referring still to FIG. 12, as the loader arms 36 are being commanded to be moved at the constant velocity, the position error associated with the loader arms 36 may, at (416) be continuously monitored with reference to the outer threshold boundary. If the reference point defined on the loader arms 36 is still positioned outside the outer threshold boundary, the open-loop velocity control may continue to be implemented. However, once the reference point is moved to a position within the outer threshold boundary, the open-loop control algorithm may transition to a ramp-down phase of the control methodology (at (418)) in which the algorithm utilizes open-loop velocity control to generate control commands for controlling the operation of the lift valve(s) 108, 110 such that the movement velocity of the loader arms 36 is ramped-down as the loader arms 36 approach the pre-defined position selected by the operator.

Additionally, as the movement velocity of the loader arms 36 is being ramped down at (418), the position error associated with the loader arms 36 may, at (420), be continuously monitored with reference to the inner threshold boundary. In doing so, if the reference point defined on the loader arms 36 is still positioned outside the inner threshold boundary, the open-loop velocity control may continue to be implemented. However, once the reference point is moved to a position within the inner threshold boundary, it may be assumed that the loader arms 36 have been properly moved to the pre-defined position selected by the operator, at which time the controller may, at (408), indicate that the open-loop control algorithm is completed and thereafter, at (410), terminate implantation of the algorithm.

As indicated above, the same algorithm shown in FIG. 12 may also be utilized to control the operation of the tilt valve(s) 166, 118 when the implement 32 is being moved to one of its pre-defined position. In doing so, the position error associated with the implement 32 (i.e., the offset between the reference point defined on the implement and the reference location associated with the operator-selected position, such as the angular offset 188 shown in FIG. 7) may be continuously monitored to determine the position of the reference point relative to the outer and inner threshold boundaries. If, at (412), the position error is greater than the outer threshold boundary, open-loop velocity control may be implemented (at (414)) in order to command that the implement 32 be moved at the desired, high-end velocity. Similarly, if, at (416), the position error is less than the outer threshold boundary but greater than the inner threshold boundary, open-loop velocity control may be implemented (at (420)) in order to control the operation of the tilt valve(s) 116, 118 in a manner that ramps-down the movement velocity of the implement 32 as it is moved closer to the operator-selected position. Thereafter, when the position error is less than the inner threshold boundary, the controller may, at (408), indicate that the open-loop control algorithm is completed and thereafter, at (410) terminate implantation of the algorithm.

It should be appreciated that, in general, the present subject matter has been described herein with reference to positioning the loader arms 36 and/or the implement 32 at a position defined relative to the work vehicle 10. However, in other embodiments, the disclosed controller 102 may be configured to monitor the current angle of inclination of the vehicle 10 (e.g., using the tilt/inclination sensors 139) and utilize such data to adjust the desired position to account for the vehicle 10 being positioned on a slope or incline.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for automatically controlling the operation of a lift assembly of a work vehicle, the lift assembly comprising an implement and a pair of loader arms coupled to the implement, the method comprising:

receiving, with a computing device, an input associated with an instruction to move at least one of the loader arms or the implement to a pre-defined position;

monitoring, with the computing device, a position of the at least one of the loader arms or the implement relative to the pre-defined position;

determining, with the computing device, a position error between a current position of a reference point associated with the at least one of the loader arms or the implement and a reference location associated with the pre-defined position;

comparing, with the computing device, the position error to and outer threshold value associated with an outer threshold boundary defined relative to the reference location;

while the position error is greater than the outer threshold value, transmitting, with the computing device, at least one first command signal in order to move the at least one of the loader arms or the implement towards the pre-defined position at a movement velocity corresponding to a desired constant velocity; and when the position error falls below the outer threshold value, transmitting, with the computing device, at least one second command signal in order to ramp down the movement velocity of the at least one of the loader arms or the implement from the desired constant velocity as the at least one of the loader arms or the implement is moved closer to the pre-defined position.

2. The method of claim 1, further comprising generating the at least one first command signal using a closed-loop velocity control sub-algorithm.

3. The method of claim 2, wherein generating the at least one first command signal comprises:

monitoring the movement velocity of the at least one of the loader arms or the implement;

generating a velocity error signal based on a difference between the monitored movement velocity and the desired constant velocity; and inputting the velocity error signal into the closed-loop velocity control sub-algorithm to generate the at least one first command signal.

4. The method of claim 2, further comprising calculating a gain signal to be input into the closed-loop velocity control sub-algorithm, the gain signal being calculated based on at least one of hydraulic oil temperature, engine speed, hydraulic cylinder pressure, the movement velocity of the at least one of the loader arms or the implement or a movement acceleration of the at least one of the loader arms or the implement.

5. The method of claim 1, further comprising generating the at least one second command signal using a closed-loop velocity control sub-algorithm or a closed-loop position control sub-algorithm.

6. The method of claim 5, wherein generating the at least one second command signal comprises:

generating a position error signal based on the determined position error; and inputting the position error signal into the closed-loop position control sub-algorithm to generate the at least one second command signal.

7. The method of claim 6, wherein the at least one second command signal is associated with moving the at least one of the loader arms or the implement at a ramp-down velocity, the ramp-down velocity being determined based on the position error signal.

8. The method of claim 5, wherein generating the at least one second command signal comprises:

monitoring the movement velocity of the at least one of the loader arms or the implement so as to determine a current movement velocity for the at least one of the loader arms or the implement;

determining a desired ramp-down velocity for the at least one of the loader arms or the implement based on the position error;

generating a velocity error signal based on a difference between the current movement velocity and the desired ramp-down velocity; and inputting the velocity error signal into the closed-loop velocity control sub-algorithm to generate the at least one second command signal.

9. The method of claim 5, further comprising calculating a gain signal to be input into the closed-loop velocity control sub-algorithm or the closed-loop position control sub-algorithm, the gain signal being calculated based on at least one of hydraulic oil temperature, engine speed, hydraulic cylinder pressure, the movement velocity of the at least one of the loader arms or the implement or a movement acceleration of the at least one of the loader arms or the implement.

10. The method of claim 1, wherein the at least one second command signal is associated with moving the at least one of the loader arms or the implement at a ramp-down velocity.

11. The method of claim 1, wherein the movement velocity is ramped down from the desired constant velocity such that movement of the at least one of the loader arms or the implement is stopped when the position error is less than an inner threshold value associated with an inner threshold boundary defined relative to the reference location, the inner threshold boundary being defined between the outer threshold boundary and the reference location.

12. A method for automatically controlling the operation of a lift assembly of a work vehicle, the lift assembly comprising an implement and a pair of loader arms coupled to the implement, the method comprising:

receiving, with a computing device, an input associated with an instruction to move at least one of the loader arms or the implement to a pre-defined position;

monitoring, with the computing device, a position of the at least one of the loader arms or the implement relative to the pre-defined position;

determining, with the computing device, a position error between a current position of a reference point associated with the at least one of the loader arms or the implement and a reference location associated with the pre-defined position;

comparing, with the computing device, the position error to an outer threshold value associated with an outer threshold boundary defined relative to the reference location;

while the position error is greater than the outer threshold value, generating, with the computing device, at least one first command signal using a closed-loop velocity control sub-algorithm;

transmitting, with the computing device, the at least one first command signal to at least one valve in order to move the at least one of the loader arms or the implement towards the pre-defined position at a movement velocity corresponding to a desired constant velocity;

when the position error falls below the outer threshold value, generating, with the computing device, at least one second command signal using the closed-loop velocity control sub-algorithm or a closed-loop position control sub-algorithm; and transmitting, with the computing device, the at least one second command signal to the at least one valve in order to ramp down the movement velocity of the at least one of the loader arms or the implement from the desired constant velocity as the at least one of the loader arms or the implement is moved closer to the pre-defined position.

13. The method of claim 12, wherein generating the at least one first command signal comprises:

monitoring the movement velocity of the at least one of the loader arms or the implement;

generating a velocity error signal based on a difference between the monitored movement velocity and the desired constant velocity; and inputting the velocity error signal into the closed-loop velocity control sub-algorithm to generate the at least one first command signal.

14. The method of claim 12, wherein generating the at least one second command signal comprises:

generating a position error signal based on the determined position error; and inputting the position error signal into the closed-loop position control sub-algorithm to generate the at least one second command signal.

15. The method of claim 14, wherein the at least one second command signal is associated with moving the at least one of the loader arms or the implement at a ramp-down velocity, the ramp-down velocity being determined based on the position error signal.

16. The method of claim 12, wherein generating the at least one second command signal comprises:

monitoring the movement velocity of the at least one of the loader arms or the implement so as to determine a current movement velocity for the at least one of the loader arms or the implement;

determining a desired ramp-down velocity for the at least one of the loader arms or the implement based on the determined position error;

generating a velocity error signal based on a difference between the current movement velocity and the desired ramp-down velocity; and inputting the velocity error signal into the closed-loop velocity control sub-algorithm to generate the at least one second command signal.

17. The method of claim 12, further comprising calculating a gain signal to be input into the closed-loop velocity control sub-algorithm or the closed-loop position control sub-algorithm, the gain signal being calculated based on at least one of hydraulic oil temperature, engine speed, hydraulic cylinder pressure, the movement velocity of the at least one of the loader arms or the implement or a movement acceleration of the at least one of the loader arms or the implement.

18. The method of claim 12, wherein the at least one second command signal is associated with moving the at least one of the loader arms or the implement at a ramp-down velocity.

19. The method of claim 12, wherein the movement velocity is ramped down from the desired constant velocity such that movement of the at least one of the loader arms or the implement is stopped when the position error is less than an inner threshold value associated with an inner threshold boundary defined relative to the reference location, the inner threshold boundary being defined between the outer threshold boundary and the reference location.

* * * * *